US009013389B2

(12) United States Patent
Koyama et al.

(10) Patent No.: US 9,013,389 B2
(45) Date of Patent: Apr. 21, 2015

(54) DISPLAY DEVICE

(75) Inventors: Jun Koyama, Sagamihara (JP); Shunpei Yamazaki, Setagaya (JP)
(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 650 days.

(21) Appl. No.: 13/037,561
(22) Filed: Mar. 1, 2011
(65) Prior Publication Data

US 2011/0216048 A1 Sep. 8, 2011

(30) Foreign Application Priority Data

Mar. 8, 2010 (JP) ..... 2010-050869

(51) Int. Cl.
*G09G 3/36* (2006.01)

(52) U.S. Cl.
CPC ..... *G09G 3/3618* (2013.01); *G09G 2310/04* (2013.01); *G09G 2320/103* (2013.01); *G09G 2310/0294* (2013.01); *G09G 3/3677* (2013.01); *G09G 2310/0286* (2013.01)
USPC ..... 345/100; 345/98

(58) Field of Classification Search
USPC ..... 345/87–104, 204–215
See application file for complete search history.

(56) References Cited

U.S. PATENT DOCUMENTS

| | | | | |
|---|---|---|---|---|
| 4,128,901 | A * | 12/1978 | Miller | 365/116 |
| 5,844,535 | A * | 12/1998 | Itoh et al. | 345/92 |
| 5,977,940 | A | 11/1999 | Akiyama et al. | |
| 6,329,973 | B1 | 12/2001 | Akimoto et al. | |
| 6,452,579 | B1 * | 9/2002 | Itoh et al. | 345/100 |
| 6,750,841 | B2 | 6/2004 | Itoh et al. | |
| 7,286,108 | B2 | 10/2007 | Tsuda et al. | |
| 7,321,353 | B2 | 1/2008 | Tsuda et al. | |
| 7,358,952 | B2 | 4/2008 | Mamba et al. | |

(Continued)

FOREIGN PATENT DOCUMENTS

| | | | |
|---|---|---|---|
| CN | 001598906 | A | 3/2005 |
| EP | 0750288 | A | 12/1996 |
| EP | 0852371 | A | 7/1998 |
| EP | 1624440 | A | 2/2006 |
| JP | 09-005789 | A | 1/1997 |
| JP | 09-329807 | A | 12/1997 |
| JP | 2000-284755 | A | 10/2000 |
| JP | 2002-182619 | A | 6/2002 |
| JP | 2005-091652 | A | 4/2005 |
| JP | 2009-116324 | A | 5/2009 |
| JP | 2010-016163 | A | 1/2010 |
| WO | WO-97/11447 | | 3/1997 |
| WO | WO-2009/051050 | | 4/2009 |
| WO | WO-2010/001783 | | 1/2010 |

OTHER PUBLICATIONS

International Search Report (Application No. PCT/JP2011/053583) Dated Mar. 22, 2011.
Written Opinion (Application No. PCT/JP2011/053583) Dated Mar. 22, 2011.
Chinese Office Action (Application No. 201180012899.3) Dated Sep. 9, 2014.

*Primary Examiner* — Kevin M Nguyen
*Assistant Examiner* — Cory Almeida
(74) *Attorney, Agent, or Firm* — Eric J. Robinson; Robinson Intellectual Property Law Office, P.C.

(57) ABSTRACT

A controller outputs a row rewriting control signal and a column rewriting control signal as well as a data signal. The row rewriting control signal is a signal selecting whether a selection signal is supplied to a first scan line, and the column rewriting control signal is a signal selecting whether a selection signal and a data signal are supplied to the second scan line and the signal line, respectively. The row rewriting control signal and the column rewriting control signal are thus output from the controller, which makes it possible to select whether a data signal is rewritten in each of a plurality of pixels arranged in matrix. Consequently, even in the case of displaying an image having a specific area, the display of which is often changed, a high-quality image can be displayed with reduced power consumption.

15 Claims, 18 Drawing Sheets

| Descriptive Legend | |
|---|---|
| 13 | controller |
| 131 | frame memory |
| 132 | comparator circuit |
| 133 | coordinate memory |
| 134 | data signal reading circuit |
| 135 | rewriting signal generation circuit |

(56) References Cited

U.S. PATENT DOCUMENTS

| | | | |
|---|---|---|---|
| 7,423,623 | B2 | 9/2008 | Akimoto et al. |
| 7,791,072 | B2 | 9/2010 | Kumomi et al. |
| 7,791,074 | B2 | 9/2010 | Iwasaki |
| 7,928,952 | B2 | 4/2011 | Akimoto et al. |
| 8,217,877 | B2 | 7/2012 | Fukutome |
| 8,531,618 | B2 | 9/2013 | Koyama et al. |
| 2002/0024496 | A1 | 2/2002 | Akimoto et al. |
| 2005/0057475 | A1 | 3/2005 | Mamba et al. |
| 2005/0151729 | A1 | 7/2005 | Akimoto et al. |
| 2007/0072439 | A1 | 3/2007 | Akimoto et al. |
| 2007/0108446 | A1 | 5/2007 | Akimoto et al. |
| 2008/0055218 | A1 | 3/2008 | Tsuda et al. |
| 2008/0316192 | A1 | 12/2008 | Akimoto et al. |
| 2009/0261325 | A1 | 10/2009 | Kawamura et al. |
| 2009/0267064 | A1 | 10/2009 | Yano et al. |
| 2011/0095288 | A1 | 4/2011 | Morosawa et al. |

* cited by examiner

Descriptive Legend

| | |
|---|---|
| 10 | pixel portion |
| 11 | first scan line driver circuit |
| 12 | signal line and second scan line driver circuit |
| 13 | controller |
| 14 | first scan line |
| 16 | second scan line |
| 17 | pixel |

Descriptive Legend

| | |
|---|---|
| 11 | first scan line driver circuit |
| 12 | signal line and second scan line driver circuit |
| 110/120 | shift register |
| 111 to 112 | latch |
| 113 | buffer |
| 121 to 124 | latch |
| 125 | DAC |
| 126 | analog buffer |
| 14 | first scan line |
| 15 | signal line |
| 16 | second scan line |

| Descriptive Legend | |
|---|---|
| 13 | controller |
| 131 | frame memory |
| 132 | comparator circuit |
| 133 | coordinate memory |
| 134 | data signal reading circuit |
| 135 | rewriting signal generation circuit |

FIG. 6

| Time → | first frame period | second frame period | third frame period | fourth frame period | fifth frame period | sixth frame period |
|---|---|---|---|---|---|---|
| frame memory 131 | storing data signal of first frame | storing data signal of second frame | storing data signal of third frame | storing data signal of fourth frame | storing data signal of fifth frame | storing data signal of sixth frame |
| comparator circuit 132 | | | comparing data signals of first and second frames | comparing data signals of second and third frames | comparing data signals of third and fourth frames | comparing data signals of fourth and fifth frames |
| coordinate memory 133 | | | storing coordinates of pixel being detected difference between first and second frames | storing coordinates of pixel being detected difference between second and third frames | storing coordinates of pixel being detected difference between third and fourth frames | storing coordinates of pixel being detected difference between fourth and fifth frames |
| data signal reading circuit 134 | | | | output data signal of first frame | output data signal of second frame | output data signal of third frame |
| rewriting signal generation circuit 135 | | | | output row rewiting control signal in rewiting of first and second frames | output row rewiting control signal in rewiting of second and third frames | output row rewiting control signal in rewiting of third and fourth frames |
| | | | | | output column rewiting control signal in rewiting of first and second frames | output column rewiting control signal in rewiting of second and third frames |
| display on pixel portion 10 | | | | image of first frame | image of second frame | image of third frame |

Descriptive Legend

| | |
|---|---|
| 11 | first scan line driver circuit |
| 12 | signal line and second scan line |
| 110 and 120 | shift register |
| 115 and 127 | AND gate |
| 128 | latch |
| 129 | DAC |
| 14 | first scan line |
| 15 | signal line |
| 16 | second scan line |

Descriptive Legend

| | |
|---|---|
| 10 | pixel portion |
| 11 | first scan line driver circuit |
| 13 | controller |
| 14 | first scan line |
| 15 | signal line |
| 16 | second scan line |
| 17 | pixel |
| 18 | signal line driver |
| 19 | second scan line driver circuit |
| 121 to 124 | latch |
| 125 | DAC |
| 126 | analog buffer |

DISPLAY DEVICE

TECHNICAL FIELD

The present invention relates to a display device. In particular, the present invention relates to an active matrix display device.

BACKGROUND ART

Active matrix display devices, which have a plurality of pixels arranged in matrix, have been in widespread use. In general, the pixel includes a transistor, a scan line electrically connected to a gate of the transistor, and a signal line electrically connected to one of a source and a drain of the transistor. The display device also includes a controller for controlling the potential of the scan line and the potential of the signal line, and a data signal supplied to each pixel is controlled with the controller.

In recent years, with an increase in concern for the global environment, attention has focused on the development of low-power consumption display devices. For example, Patent Document 1 discloses a technique for reducing the power consumption of a display device by reducing the rewriting frequency thereof. The structure of the display device disclosed in Patent Document 1 will be specifically described below.

In the display device disclosed in Patent Document 1, set are a scanning period for scanning one screen, and a break period which follows the scanning period and is longer than the scanning period. According to the technique disclosed in Patent document 1, during the break period, the potential of a scan line is fixed to the potential of a non-selection signal while (1) the potential of a signal line is fixed to a predetermined potential, (2) the potential of a signal line is fixed to a predetermined potential and then brought into a floating state, or (3) an alternating-current driving signal having a frequency lower than or equal to that of a data signal is supplied to a signal line. Thus, it is possible to reduce the power consumed when the potential of the signal line varies during the break period.

REFERENCE

[Patent Document 1] Japanese Published Patent Application No. 2002-182619

DISCLOSURE OF INVENTION

In the display device disclosed in Patent Document 1, a data signal is rewritten at the same frequency in all the plurality of pixels arranged in matrix. Therefore, the display device disclosed in Patent Document 1 is not suitable for displaying an image having a specific area, the display of which is often changed. That is, in order to display a high-quality image in the area, the display of which is often changed, the aforementioned break period needs to be shortened so that the data signal is rewritten frequently. In that case, the data signal is also rewritten frequently in the other area (in which the display is not changed so much). This leads to a reduction in the advantage which the display device disclosed in Patent Document 1 has over conventional display devices (the reduction in power consumption).

Thus, an object of one embodiment of the present invention is to provide a display device capable of displaying a high-quality image with reduced power consumption, even in the case of displaying an image having a specific area, the display of which is often changed.

The aforementioned problem can be solved by controlling the rewriting frequency of a data signal in each specific area (e.g., in each pixel).

That is, one embodiment of the present invention is a display device including: a controller which compares data signals for forming images of successive two frames, detects a difference in each of a plurality of pixels arranged in matrix, and outputs a row rewriting control signal indicating whether the difference is detected in at least one of a first pixel to an n-th pixel (n is a natural number of two or more) arranged in the same row, and a column rewriting control signal indicating whether the difference is detected in a k-th pixel (k is a natural number more than or equal to one and less than or equal to n); a first scan line which is electrically connected to the first pixel to the n-th pixel and to which a selection signal is supplied in accordance with the row rewriting control signal; a second scan line which is electrically connected to all the plurality of pixels arranged in the same column as the k-th pixel and to which a selection signal is supplied in accordance with the column rewriting control signal; and a signal line which is electrically connected to all the plurality of pixels arranged in the same column as the k-th pixel and to which the data signal is supplied in accordance with the column rewriting control signal. The k-th pixel includes: a first transistor, a gate of which is electrically connected to the first scan line and one of a source and a drain of which is electrically connected to the signal line; and a second transistor, a gate of which is electrically connected to the second scan line and one of a source and a drain of which is electrically connected to the other of the source and the drain of the first transistor.

The display device of one embodiment of the present invention includes the controller which outputs the row rewriting control signal and the column rewriting control signal as well as the data signal. Note that the row rewriting control signal is a signal selecting whether a selection signal is supplied to the first scan line, and the column rewriting control signal is a signal selecting whether a selection signal and a data signal are supplied to the second scan line and the signal line, respectively. The row rewriting control signal and the column rewriting control signal are thus output from the controller, which makes it possible to select whether a data signal is rewritten in each of the plurality of pixels arranged in matrix. Consequently, even in the case of displaying an image having a specific area, the display of which is often changed, a high-quality image can be displayed with reduced power consumption.

BRIEF DESCRIPTION OF DRAWINGS

In the accompanying drawings:

FIG. 6 is a diagram illustrating an example of the operation of a controller;

BEST MODE FOR CARRYING OUT THE INVENTION

Embodiments of the present invention will be described in detail below with reference to drawings. Note that the present invention is not limited to the following description, and it is apparent to those skilled in the art that modes and details can be modified in various ways without departing from the spirit and scope of the present invention. Therefore, the present invention is not construed as being limited to the description of the embodiments.

(Example of Active Matrix Display Device)

First, an example of an active matrix display device will be described with reference to FIGS. 1A and 1B.

Figure 1A:
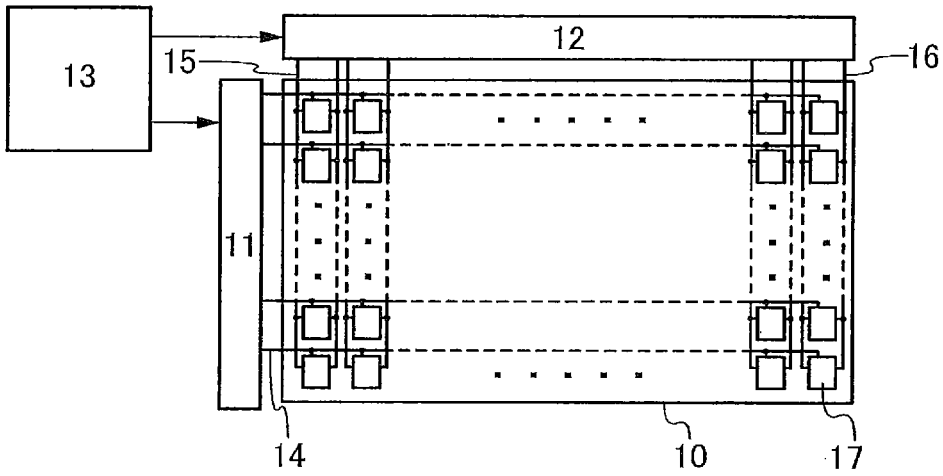
FIG. 1A is a diagram illustrating an example of a display device.

FIG. 1A is a diagram illustrating an example of the configuration of the active matrix display device. The display device illustrated in FIG. 1A includes: a pixel portion 10; a first scan line driver circuit 11; a signal line and second scan line driver circuit 12; a controller 13; a plurality of first scan lines 14 which are arranged in parallel or substantially parallel to each other, and the potential of which is controlled by the first scan line driver circuit 11; a plurality of signal lines 15 which are arranged in parallel or substantially parallel to each other, and the potential of which is controlled by the signal line and second scan line driver circuit 12; and a plurality of second scan lines 16 which are arranged in parallel or substantially parallel to each other, and the potential of which is controlled by the signal line and second scan line driver circuit 12. Further, the pixel portion 10 includes a plurality of pixels 17 arranged in matrix. Note that each of the plurality of first scan lines 14 is electrically connected to a plurality of pixels 17 arranged in any row, among the plurality of pixels 17 arranged in matrix. Each of the plurality of signal lines 15 and each of the plurality of second scan lines 16 are electrically connected to a plurality of pixels 17 arranged in any column, among the plurality of pixels 17 arranged in matrix. From the controller 13, signals such as a start signal for driving the first scan line, a clock signal for driving the first scan line, and a row rewriting control signal, and driving power such as a high-potential power supply (Vdd) and a low-potential power supply (Vss) are input to the first scan line driver circuit 11. Further, from the controller 13, signals such as a start signal for driving the signal line and the second scan line, a clock signal for driving the signal line and the second scan line, a column rewriting control signal, and a data signal, and driving power such as a high-potential power supply (Vdd) and a low-potential power supply (Vss) are input to the signal line and second scan line driver circuit 12.

Figure 1B:
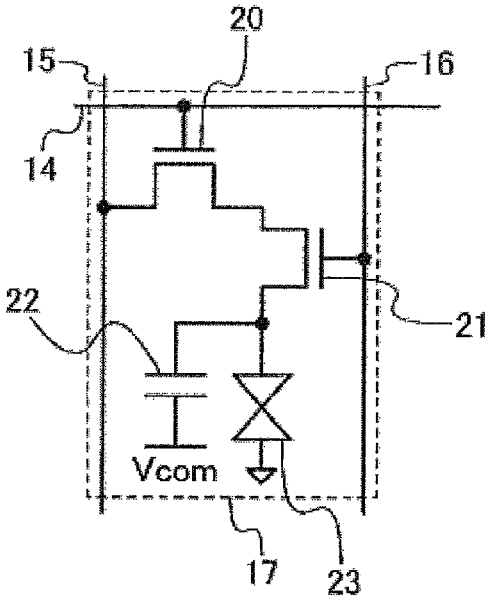
FIG. 1B is a circuit diagram illustrating an example of a pixel.

FIG. 1B is an example of a circuit diagram of the pixel 17 included in the display device illustrated in FIG. 1A. The pixel 17 illustrated in FIG. 1B includes: a transistor 20, a gate of which is electrically connected to the first scan line 14 and one of a source and a drain of which is electrically connected to the signal line 15; a transistor 21, a gate of which is electrically connected to the second scan line 16 and one of a source and a drain of which is electrically connected to the other of the source and the drain of the transistor 20; a capacitor 22, one electrode of which is electrically connected to the other of the source and the drain of the transistor 21 and the other electrode of which is electrically connected to a wiring supplying a common potential (Vcom) (also referred to as a common potential line); and a liquid crystal element 23, one electrode of which (also referred to as a pixel electrode) is electrically connected to the other of the source and the drain of the transistor 21 and the one electrode of the capacitor 22, and the other electrode of which (also referred to as a counter electrode) is electrically connected to a wiring supplying a counter potential. Note that the transistor 20 and the transistor 21 are n-channel transistors. The common potential (Vcom) and the counter potential can have the same potential.

(Example of Operation of Active Matrix Display Device)

Next, an example of the operation of the aforementioned display device will be described.

First, data signals for making an image on the pixel portion 10 are successively input to the controller 13. The controller 13 compares some of the input data signals, which form images of successive two frames, and detects a difference in each of the plurality of pixels 17 arranged in matrix. Furthermore, the controller 13 generates a row rewriting control signal and a column rewriting control signal on the basis of the detected difference.

The row rewriting control signal is a signal indicating whether a difference is detected in at least one of the plurality of pixels 17 arranged in the same row in the pixel portion 10. The column rewriting control signal is a signal indicating whether a difference is detected in each of the pixels 17. That is, the row rewriting control signal and the column rewriting control signal each are a binary signal. The frequency of the column rewriting control signal is higher than that of the row rewriting control signal. Specifically, the row rewriting control signal can be changed every horizontal scan period (also referred to as gate selection period), and the column rewriting control signal can be changed every period in the horizontal scan period, during which the signal line 15 is selected (during which a data signal is input to the pixel 17). Note that in the following description, the row rewriting control signal in the case where "a difference is detected in at least one of the plurality of pixels 17 arranged in the same row" is referred to as a high-level signal, and the row rewriting control signal in the case where "a difference is not detected in any of the plurality of pixels 17 arranged in the same row" is referred to as a low-level signal for convenience. Similarly, the column rewriting control signal in the case where "a difference is detected in each of the plurality of pixels 17" is referred to as a high-level signal, and the column rewriting control signal in the case where "a difference is not detected in any of the plurality of pixels 17" is referred to as a low-level signal.

The first scan line driver circuit 11 has a function of sequentially supplying selection signals to the plurality of first scan lines 14. Note that the row rewriting control signal is input to the first scan line driver circuit 11. The row rewriting control signal is a signal selecting whether a selection signal is supplied to the first scan lines 14 from the first scan line driver circuit 11. Specifically, in the period during which the first scan lines 14 are selected (a horizontal scan period), a selection signal is supplied to the first scan lines 14 when the row rewriting control signal is a high-level signal; and a non-selection signal is supplied to the plurality of first scan lines 14 when the row rewriting control signal is a low-level signal. Here, the selection signal is a signal to turn on the transistor 20, and the non-selection signal is a signal to turn off the transistor 20.

The signal line and second scan line driver circuit 12 has a function of sequentially supplying data signals to the plurality of signal lines 15, and sequentially supplying selection signals to the plurality of second scan lines 16. Note that the column rewriting control signal is input to the signal line and second scan line driver circuit 12. The column rewriting control signal is a signal selecting whether a data signal and a selection signal are respectively supplied to the signal lines 15 and the second scan lines 16 from the signal line and second scan line driver circuit 12. Specifically, in the period during which the signal lines 15 and the second scan lines 16 are selected, a data signal is supplied to the signal lines 15 and a selection signal is supplied to the second scan lines 16 when the column rewriting control signal is a high-level signal. On the other hand, when the column rewriting control signal is a low-level signal, a data signal is not supplied to the signal lines 15 and a non-selection signal is supplied to the second scan lines 16. Here, "a data signal is not supplied to the signal lines 15" means that a fixed potential or a predetermined AC voltage is supplied to the signal lines 15, or that the signal lines 15 are brought into a floating state.

As described above, in the aforementioned display device, the row rewriting control signal and the column rewriting control signal are output from the controller 13, which makes it possible to select whether a data signal is rewritten in each of the plurality of pixels 17 arranged in matrix. Consequently, even in the case of displaying an image having a specific area, the display of which is often changed, a high-quality image can be displayed with reduced power consumption.

(Example of Configuration of First Scan Line Driver Circuit 11)

Figure 2A:
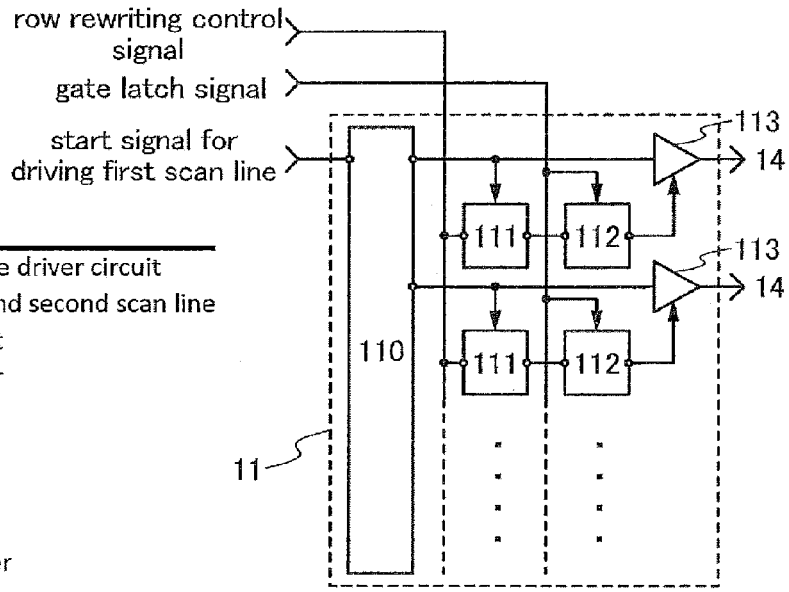
FIG. 2A is a diagram illustrating an example of a first scan line driver circuit.

Next, an example of the configuration of the first scan line driver circuit 11 included in the aforementioned display device will be described with reference to FIG. 2A. The first scan line driver circuit 11 illustrated in FIG. 2A includes: a shift register 110 having a plurality of output terminals; a latch 111 whose input terminal is electrically connected to a wiring supplying a row rewriting control signal; a latch 112 whose input terminal is electrically connected to an output terminal of the latch 111; and a buffer 113 whose input terminal is electrically connected to any of a plurality of output terminals of the shift register 110, and whose output terminal is electrically connected to any of the plurality of first scan lines 14.

The shift register 110 has a function of sequentially supplying selection signals from the plurality of output terminals when a start signal for driving the first scan line is input from the outside.

The latch 111 is electrically connected to any of the plurality of output terminals of the shift register 110. The latch 111 has a function of retaining a row rewriting control signal (a binary signal: a high-level signal or a low-level signal) in a period during which a selection signal is supplied from the output terminals, and outputting the row rewriting control signal.

The latch 112 is electrically connected to a wiring supplying a gate latch signal. The latch 112 has a function of retaining an output signal of the latch 111 (a binary signal: a high-level signal or a low-level signal) in a period during which a transfer signal is supplied from the gate latch signal, and outputting the signal. Note that the gate latch signal is a signal indicating whether the signal retained by the latch 111 is transferred to the latch 112. That is, the gate latch signal is a binary signal (a transfer signal and a non-transfer signal). Here, the gate latch signal indicates a non-transfer signal in a period during which the shift register 110 sequentially supplies selection signals (a sampling period), and the gate latch signal indicates a transfer signal in a period between two successive sampling periods (a vertical retrace period).

The buffer 113 has a function of selecting a signal supplied to the first scan line 14 between the output signal of the shift register 110 and a non-selection signal. Specifically, the output signal of the shift register 110 is supplied to the first scan line 14 when the output signal of the latch 112 is a high-level signal, and a non-selection signal is supplied to the first scan line 14 when the output signal of the latch 112 is a low-level signal.

(Example of Operation of First Scan Line Driver Circuit 11)

Figure 3:
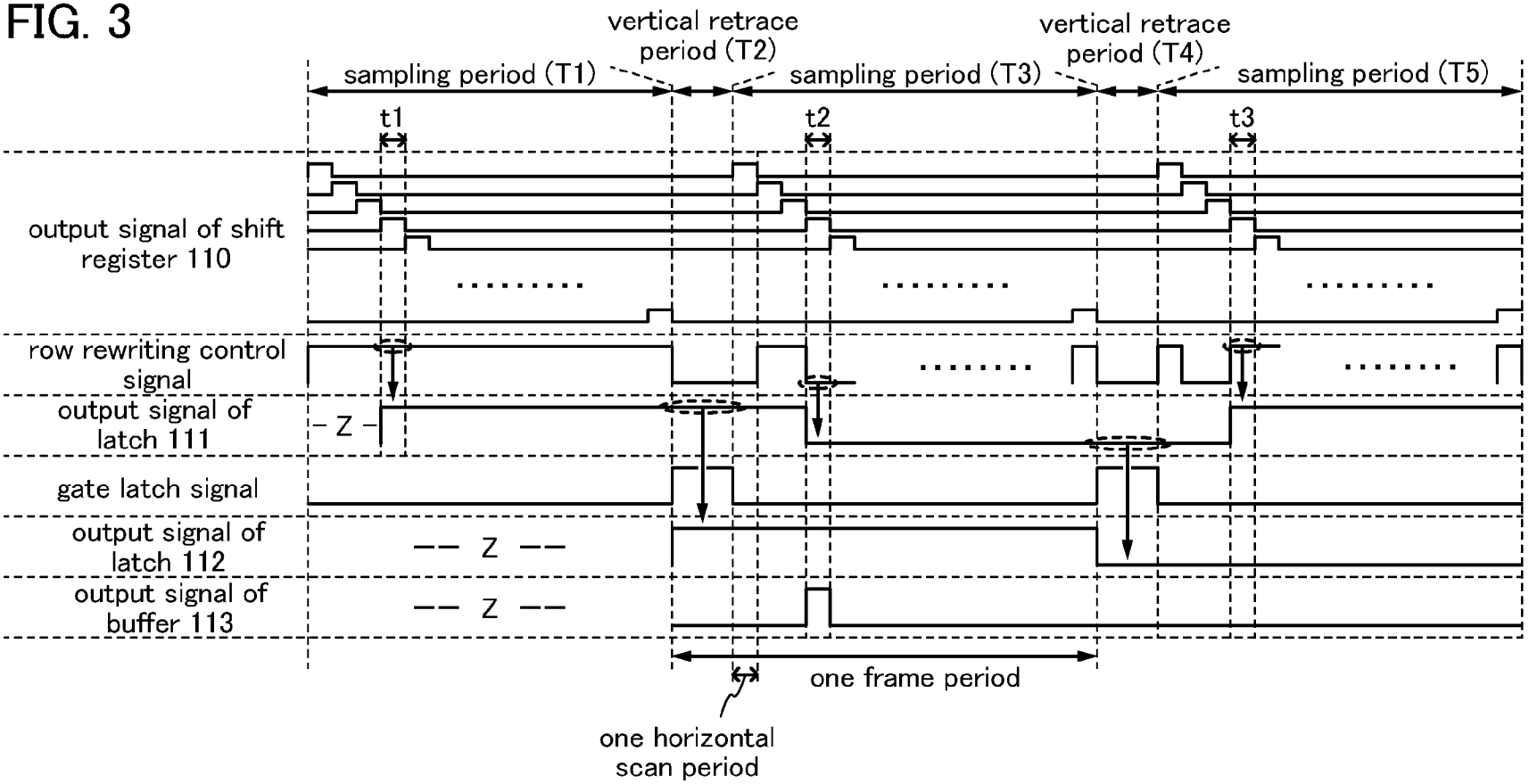
FIG. 3 is a diagram illustrating an example of the operation of a first scan line driver circuit.

An example of the operation of the aforementioned first scan line driver circuit 11 will be described below with reference to FIG. 3.

First, in a sampling period (T1), selection signals are sequentially output from the plurality of output terminals of the shift register 110. The latch 111 electrically connected to the output terminal from which the selection signal is output in a period t1, retains a row rewriting control signal in the period t1 and outputs the row rewriting control signal. Here, the row rewriting control signal in the period t1 is a high-level signal.

Next, in a vertical retrace period (T2), a transfer signal is input to the latch 112. Then, the latch 112 retains the output signal of the latch 111 (the row rewriting control signal in the period t1=a high-level signal) and outputs the signal. Further, the output signal of the latch 112 is input to the buffer 113, whereby the output signal of the buffer 113 becomes equal to an output signal of the output terminal from which the selection signal is output in the period t1.

Next, in a sampling period (T3), selection signals are sequentially output from the plurality of output terminals of the shift register 110 as in the sampling period (T1). At this time, in a period t2, the selection signal is input to the aforementioned latch 111 (the latch 111 electrically connected to the output terminal from which the selection signal is output in the period t1). Accordingly, the latch 111 retains a row rewriting control signal in the period t2 and outputs the row rewriting control signal. Here, the row rewriting control signal in the period t2 is a low-level signal. In the sampling period (T3), the latch 112 retains the output signal in the vertical retrace period (T2), whereby the output signal of the buffer 113 in the sampling period (T3) becomes equal to an output signal of the output terminal from which the selection signal is output in the period t1 and the period t2. That is, the buffer 113 supplies the selection signal to the first scan line 14 in the period t2.

Then, in a vertical retrace period (T4), a transfer signal is input to the latch 112 as in the vertical retrace period (T2). Thus, the latch 112 retains the output signal of the latch 111 (the row rewriting control signal in the period t2=a low-level signal) and outputs the signal. Further, the output signal of the latch 112 is input to the buffer 113, whereby the output signal of the buffer 113 becomes a non-selection signal.

Next, in a sampling period (T5), selection signals are sequentially output from the plurality of output terminals of the shift register 110 as in the sampling period (T1) and the sampling period (T3). At this time, in a period t3, the selection signal is input to the aforementioned latch 111 (the latch 111 electrically connected to the output terminal from which the selection signal is output in the period t1 and the period t2). Accordingly, the latch 111 retains a row rewriting control signal in the period t3 and outputs the row rewriting control signal. Here, the row rewriting control signal in the period t3 is a high-level signal. In the sampling period (T5), the latch 112 retains the output signal in the vertical retrace period (T4), whereby the output signal of the buffer 113 in the sampling period (T5) becomes a non-selection signal. That is, the buffer 113 supplies a non-selection signal to the first scan line 14 in the sampling period (T5).

The above operation enables the first scan line driver circuit 11 to select whether a selection signal is supplied to the first scan line 14, in accordance with a row rewriting control signal. Note that in the aforementioned operation of the display device, each of the periods t1, t2, and t3 is one horizontal scan period, and the vertical retrace period and the subsequent sampling period are one frame period.

(Example of Configuration of Signal Line and Second Scan Line Driver Circuit 12)

Next, an example of the configuration of the signal line and second scan line driver circuit 12 included in the aforementioned display device will be described with reference to FIG. 2B. The signal line and second scan line driver circuit 12 illustrated in FIG. 2B includes: a shift register 120 having a plurality of output terminals; a latch 121 whose input terminal is electrically connected to a wiring supplying a column rewriting control signal; a latch 122 whose input terminal is electrically connected to an output terminal of the latch 121 and whose output terminal is electrically connected to any of the plurality of second scan lines 16; a latch 123 whose input terminal is electrically connected to a wiring supplying a data signal; a latch 124 whose input terminal is electrically connected to an output terminal of the latch 123; a digital to analog converter circuit (DAC) 125 whose input terminal is electrically connected to an output terminal of the latch 124; and an analog buffer 126 whose input terminal is electrically connected to an output terminal of the digital to analog converter circuit (DAC) 125 and whose output terminal is electrically connected to any of the plurality of signal lines 15.

The shift register 120 has a function of sequentially supplying selection signals from the plurality of output terminals when a start signal for driving the signal line and the second scan line is input from the outside.

The latch 121 is electrically connected to any of the plurality of output terminals of the shift register 120. The latch 121 has a function of retaining a column rewriting control signal (a binary signal: a high-level signal or a low-level signal) in a period during which a selection signal is supplied from the output terminals, and outputting the column rewriting control signal.

The latch 122 is electrically connected to a wiring supplying a source latch signal. The latch 122 has a function of retaining an output signal of the latch 121 (a binary signal: a high-level signal or a low-level signal) in a period during which a transfer signal is supplied from the source latch signal, and outputting the signal. Note that the source latch signal is a signal indicating whether the signal retained by the latch 121 is transferred to the latch 122. That is, the source latch signal is a binary signal (a transfer signal and a non-transfer signal). Here, the source latch signal indicates a non-transfer signal in a period during which the shift register 120 sequentially supplies selection signals (a sampling period), and the source latch signal indicates a transfer signal in a period between two successive sampling periods (a horizontal retrace period). An output signal of the latch 122 is supplied to the gate of the transistor 21 in the pixel 17 through any of the plurality of second scan lines 16; thus, the latch 122 needs to output a signal to turn on the transistor 21 (a selection signal) when a high-level signal is input from the latch 121 in a horizontal retrace period, and needs to output a signal to turn off the transistor 21 (a non-selection signal) when a low-level signal is input from the latch 121 in a horizontal retrace period.

The latch 123 is electrically connected to any of the plurality of output terminals of the shift register 120. The latch 123 has a function of retaining a data signal in a period during which a selection signal is supplied from the output terminal, and outputting the data signal. Note that the data signal is a multi-bit digital signal.

The latch 124 is electrically connected to a wiring supplying a source latch signal. The latch 124 has a function of retaining an output signal of the latch 123 (a multi-bit signal) in a period during which a transfer signal is supplied from the source latch signal, and outputting the signal.

The digital to analog converter circuit (DAC) 125 has a function of converting a digital data signal input from the latch 124 into an analog signal, and outputting the analog signal.

The analog buffer 126 has a function of selecting whether a data signal (an analog data signal) is supplied to the signal line 15, in accordance with the output signal of the latch 122 (a binary signal: a high-level signal or a low-level signal). Specifically, the analog buffer 126 supplies a data signal (an analog data signal) to the signal line 15 when the output signal of the latch 122 is a high-level signal, and does not supply a data signal (an analog data signal) to the signal line 15 when the output signal of the latch 122 is a low-level signal.

(Example of Operation of Signal Line and Second Scan Line Driver Circuit 12)

Figure 4:
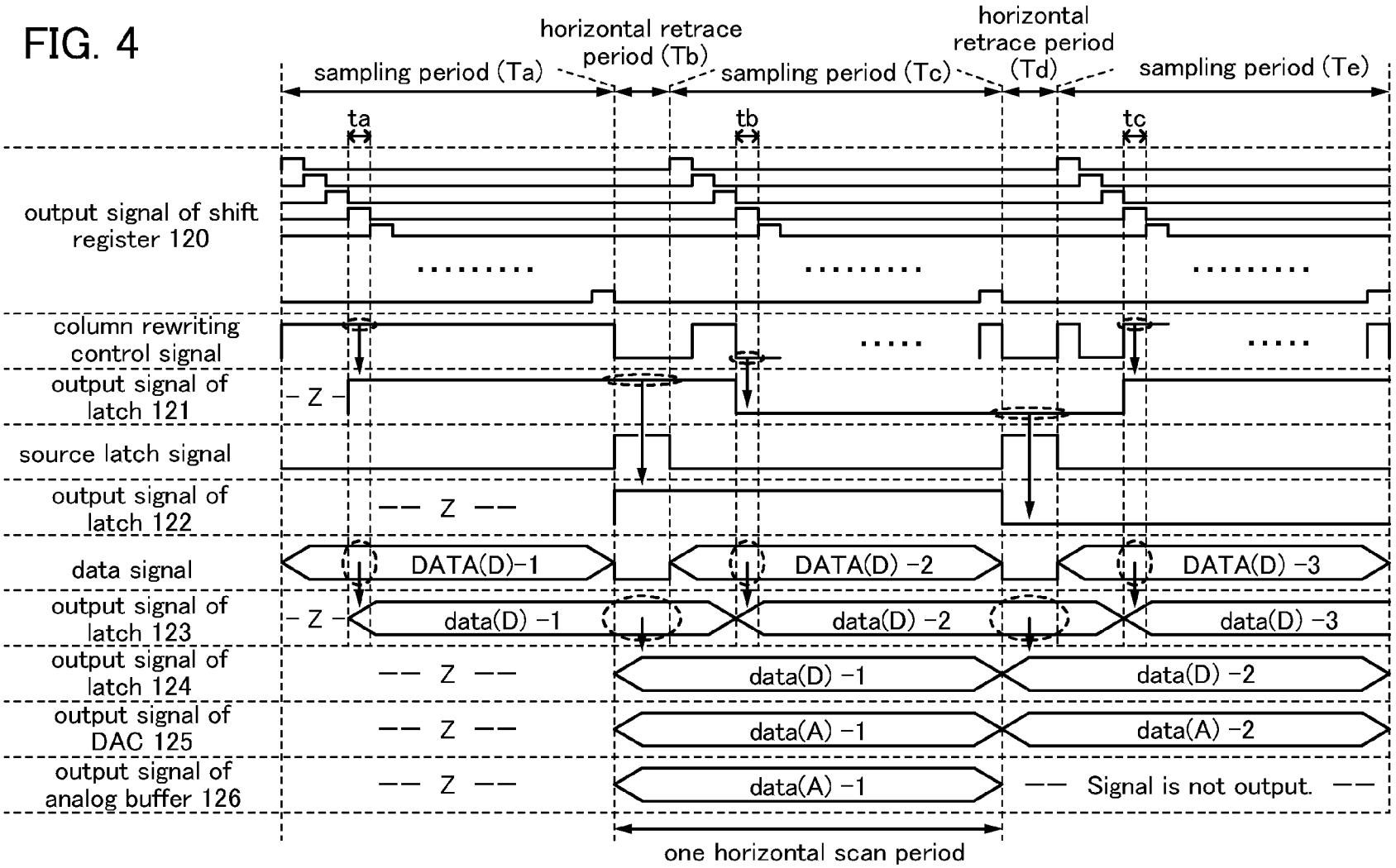
FIG. 4 is a diagram illustrating an example of the operation of a signal line and second scan line driver circuit.

An example of the operation of the aforementioned signal line and second scan line driver circuit 12 will be described with reference to FIG. 4.

First, in a sampling period (Ta), selection signals are sequentially output from the plurality of output terminals of the shift register 120. The latch 121 electrically connected to the output terminal from which the selection signal is output in a period ta, retains a column rewriting control signal in the period ta and outputs the column rewriting control signal. Here, the column rewriting control signal in the period ta is a high-level signal. The latch 123 electrically connected to the output terminal from which the selection signal is output in the period ta, retains a specific data signal (data(D)-1) in the period ta included in a multi-bit data signal (DATA(D)-1), and outputs the data signal (data(D)-1).

Next, in a horizontal retrace period (Tb), a transfer signal is input to the latch 122 and the latch 124. Then, the latch 122 retains the output signal of the latch 121 (the column rewriting control signal in the period ta=a high-level signal) and outputs the signal. The output signal of the latch 122 is supplied to the gate of the transistor 21 in the pixel 17 through any of the plurality of second scan lines 16, so that the transistor 21 is turned on. The latch 124 retains the output signal of the latch 123 (the data signal (data(D)-1) in the period ta) and outputs the signal. The output signal of the latch 124 is input to the digital to analog converter circuit (DAC) 125, whereby the digital to analog converter circuit (DAC) 125 outputs an analog data signal (data(A)-1). The output signal of the digital to analog converter circuit (DAC) 125 is input to the analog buffer 126. Further, the output signal of the latch 122 (the column rewriting control signal in the period ta=a high-level signal) is input to the analog buffer 126. Thus, the output signal of the analog buffer 126 becomes an analog data signal (data(A)-1).

Next, in a sampling period (Tc), selection signals are sequentially output from the plurality of output terminals of the shift register 120 as in the sampling period (Ta). At this time, the aforementioned latch 121 (the latch 121 electrically connected to the output terminal from which the selection signal is output in the period ta), retains a column rewriting control signal in the period tb and outputs the column rewriting control signal. Here, the column rewriting control signal in the period tb is a low-level signal. Further, in the sampling period (Tc), the aforementioned latch 123 (the latch 123 electrically connected to the output terminal from which the selection signal is output in the period ta), retains a data signal (data(D)-2) in the period tb included in a multi-bit data signal (DATA(D)-2), and outputs the data signal (data(D)-2). In the sampling period (Tc), the latch 122 and the latch 124 retain the output signal in a horizontal retrace period (Tb), whereby the aforementioned transistor 21 (the transistor 21 whose gate is supplied with the output signal of the latch 122) is kept in an on state in the sampling period (Tc), and the analog data signal (data(A)-1) is kept as the output signal of the analog buffer 126. In other words, the analog buffer 126 keeps supplying the analog data signal (data(A)-1) in the sampling period (Tc).

Next, in a horizontal retrace period (Td), a transfer signal is input to the latch 122 and the latch 124 as in the horizontal retrace period (Tb). Then, the latch 122 retains the output signal of the latch 121 (the column rewriting control signal in the period tb=a low-level signal) and outputs the signal. The output signal of the latch 122 is supplied to the gate of the transistor 21 in the pixel 17 through any of the plurality of second scan lines 16, so that the transistor 21 is turned off. The latch 124 retains the output signal of the latch 123 (the data signal (data(D)-2) in the period tb) and outputs the signal. The output signal of the latch 124 is input to the digital to analog converter circuit (DAC) 125, whereby the digital to analog converter circuit (DAC) 125 outputs an analog data signal (data(A)-2). The output signal of the digital to analog converter circuit (DAC) 125 is input to the analog buffer 126. Note that the output signal of the latch 122 (the column rewriting control signal in the period ta=a low-level signal) is input to the analog buffer 126. Thus, the analog data signal (data(A)-2) is not supplied to the signal line 15.

Next, in a sampling period (Te), selection signals are sequentially output from the plurality of output terminals of the shift register 120 as in the sampling periods (Ta) and (Tc). At this time, in a period tc, the selection signal is input to the aforementioned latch 121 (the latch 121 electrically connected to the output terminal from which the selection signal is output in the periods ta and tb). Accordingly, the latch 121 retains a column rewriting control signal in the period tc and outputs the column rewriting control signal. Here, the column rewriting control signal in the period tc is a high-level signal. Further, in the sampling period (Te), the aforementioned latch 123 (the latch 123 electrically connected to the output terminal from which the selection signal is output in the periods to and tb), retains a data signal (data(D)-3) in the period tc included in a multi-bit data signal (DATA(D)-3), and outputs the data signal (data(D)-3). In the sampling period (Te), the latch 122 and the latch 124 retain the output signal in the horizontal retrace period (Td), whereby the aforementioned transistor 21 (the transistor 21 whose gate is supplied with the output signal of the latch 122) is kept in an off state in the sampling period (Te), and the analog data signal (data(A)-2) keeps not being supplied to the signal line 15.

The above operation enables the signal line and second scan line driver circuit 12 to select whether a data signal is supplied to the signal line 15 and whether a selection signal is supplied to the second scan line 16, in accordance with a column rewriting control signal. Note that in the aforementioned operation of the display device, a horizontal retrace period and the subsequent sampling period are one horizontal scan period.

(Example of Configuration of Controller 13)

Figure 5:
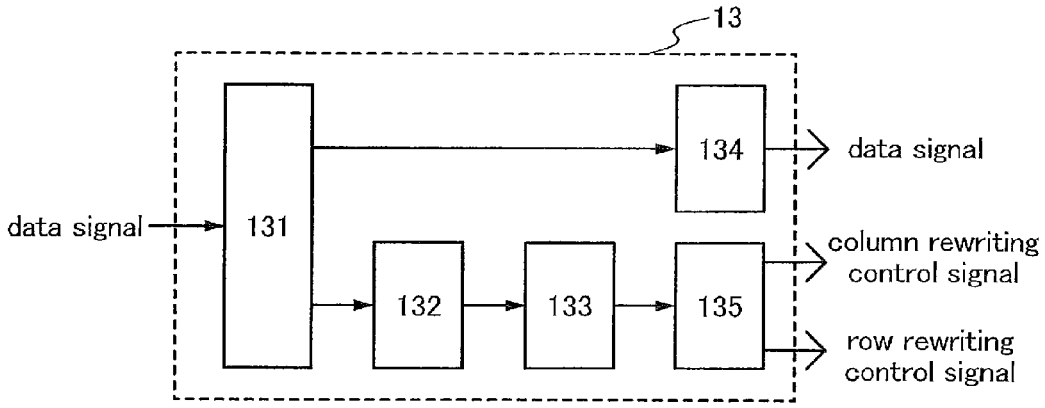
FIG. 5 is a diagram illustrating an example of a controller.

Next, an example of the configuration of the controller 13 included in the aforementioned display device will be described with reference to FIG. 5. The controller 13 illustrated in FIG. 5 includes: a frame memory 131 storing data signals which are input from the outside and form images of a plurality of frames; a comparator circuit 132 comparing the data signals stored in the frame memory 131 which form images of successive two frames, and detecting a difference; a coordinate memory 133 storing the coordinates of a pixel in which a difference has been detected by the comparator circuit 132; a data signal reading circuit 134 reading a data signal from the frame memory 131 and outputting the data signal to the signal line and second scan line driver circuit 12; and a rewriting signal generation circuit 135 generating a column rewriting control signal and a row rewriting control signal on the basis of the coordinate data stored in the coordinate memory 133, and outputting the column rewriting control signal and the row rewriting control signal to the signal line and second scan line driver circuit 12 and the first scan line driver circuit 11, respectively.

(Example of Operation of Controller 13)

An example of the operation of the aforementioned controller 13 will be described below with reference to FIG. 6.

In a first frame period during which a data signal for forming an image of a first frame is input from the outside to the controller 13, the frame memory 131 stores the data signal for forming the image of the first frame.

In a second frame period during which a data signal for forming an image of a second frame is input from the outside to the controller 13, the frame memory 131 stores the data signal for forming the image of the second frame.

In a third frame period during which a data signal for forming an image of a third frame is input from the outside to the controller 13, the frame memory 131 stores the data signal for forming the image of the third frame. The comparator circuit 132 compares the data signals stored in the frame memory 131, which form the image of the first frame and the image of the second frame, and detects a difference. Further, the coordinate memory 133 stores the coordinates of a pixel in which a difference has been detected between the data signal for forming the image of the first frame and the data signal for forming the image of the second frame.

Then, in a fourth frame period during which a data signal for forming an image of a fourth frame is input from the outside to the controller 13, the frame memory 131 stores the data signal for forming the image of the fourth frame. The comparator circuit 132 compares the data signals stored in the frame memory 131, which form the image of the second frame and the image of the third frame, and detects a difference. Further, the coordinate memory 133 stores the coordinates of a pixel in which a difference has been detected between the data signal for forming the image of the second frame and the data signal for forming the image of the third frame. The data signal reading circuit 134 reads the data signal stored in the frame memory 131, which forms the image of the first frame, and then outputs the data signal for forming the image of the first frame to the signal line and second scan line driver circuit 12. Moreover, the rewriting signal generation circuit 135 generates, on the basis of the coordinate data stored in the coordinate memory 133, a row rewriting control signal in rewriting of the image of the first frame and the image of the second frame. Then, the rewriting signal generation circuit 135 outputs the row rewriting control signal to the first scan line driver circuit 11. Note that in this period, the image of the first frame is displayed on the pixel portion 10.

Next, in a fifth frame period during which a data signal for forming an image of a fifth frame is input from the outside to the controller 13, the frame memory 131 stores the data signal for forming the image of the fifth frame. The comparator circuit 132 compares the data signals stored in the frame memory 131, which form the image of the third frame and the image of the fourth frame, and detects a difference. Further, the coordinate memory 133 stores the coordinates of a pixel in which a difference has been detected between the data signal for forming the image of the third frame and the data signal for forming the image of the fourth frame. The data signal reading circuit 134 reads the data signal stored in the frame memory 131, which forms the image of the second frame, and then outputs the data signal for forming the image of the second frame to the signal line and second scan line driver circuit 12. Moreover, the rewriting signal generation circuit 135 generates, on the basis of the coordinate data stored in the coordinate memory 133, a row rewriting control signal in rewriting of the image of the second frame and the image of the third frame, and a column rewriting control signal in rewriting of the image of the first frame and the image of the second frame. Then, the rewriting signal generation circuit 135 outputs the row rewriting control signal and the column rewriting control signal to the first scan line driver circuit 11 and the signal line and second scan line driver circuit 12, respectively. Note that in this period, the image of the second frame is displayed on the pixel portion 10.

After that, the operation described above is sequentially performed, whereby images can be displayed on the pixel portion 10 in sequence.

As described above, in the aforementioned display device, the row rewriting control signal and the column rewriting control signal are output from the controller 13, which makes it possible to select whether a data signal is rewritten in each of the plurality of pixels 17 arranged in matrix. Consequently, even in the case of displaying an image having a specific area, the display of which is often changed, a high-quality image can be displayed with reduced power consumption.

(Modified Example of Active Matrix Display Device)

The display device having the aforementioned configuration is one embodiment of the present invention, and the invention includes a display device having some differences from the aforementioned display device.

Figure 7A:
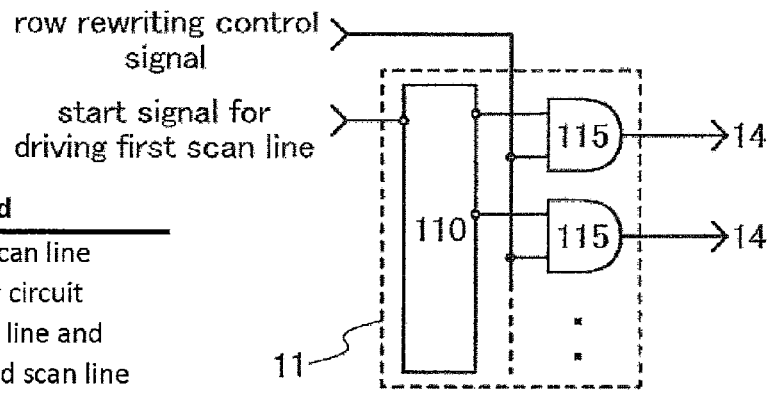
FIG. 7A is a diagram illustrating an example of a first scan line driver circuit.

For example, although the aforementioned display device has a configuration in which the first scan line driver circuit 11 includes the shift register 110, the latch 111, the latch 112, and the buffer 113 (see FIG. 2A), another configuration can be employed in which the first scan line driver circuit 11 includes the shift register 110, and an AND gate 115 whose first input terminal is electrically connected to any of the plurality of output terminals of the shift register 110, whose second input terminal is electrically connected to a wiring supplying a row rewriting control signal, and whose output terminal is electrically connected to any of the plurality of first scan lines 14 (see FIG. 7A). In the first scan line driver circuit 11 illustrated in FIG. 7A, whether a selection signal is supplied to the first scan line 14 can be selected by synchronizing the timing of the output signal of the shift register 110 with the timing of the row rewriting control signal. Note that in the display device including the first scan line driver circuit 11 illustrated in FIG. 7A, it is necessary that the timing of image display on the pixel portion 10 be one frame period earlier than the timing illustrated in FIG. 6, or the timing of input of a row rewriting control signal to the first scan line driver circuit 11 be one frame period later than the timing illustrated in FIG. 6. In the former case, in order that the timing of display on the pixel portion 10 be one frame period earlier, the timing of output of a data signal from the data signal reading circuit 134 and the timing of output of a column rewriting control signal from the rewriting signal generation circuit 135 are also necessary to be one frame period earlier. Specific operation in the former case is as follows. The data signal of the first frame illustrated in FIG. 6 needs to be input to the signal line and second scan line driver circuit 12 in the third frame period, and the column rewriting control signal in rewriting of the image based on the data signal of the first frame and the image based on the data signal of the second frame needs to be input to the signal line and second scan line driver circuit 12 in the fourth frame period. Similarly, specific operation in the latter case is as follows. The row rewriting control signal in rewriting of the image based on the data signal of the first frame and the image based on the data signal of the second frame illustrated in FIG. 6 needs to be input to the first scan line driver circuit 11 in the fifth frame period.

Figure 2B:
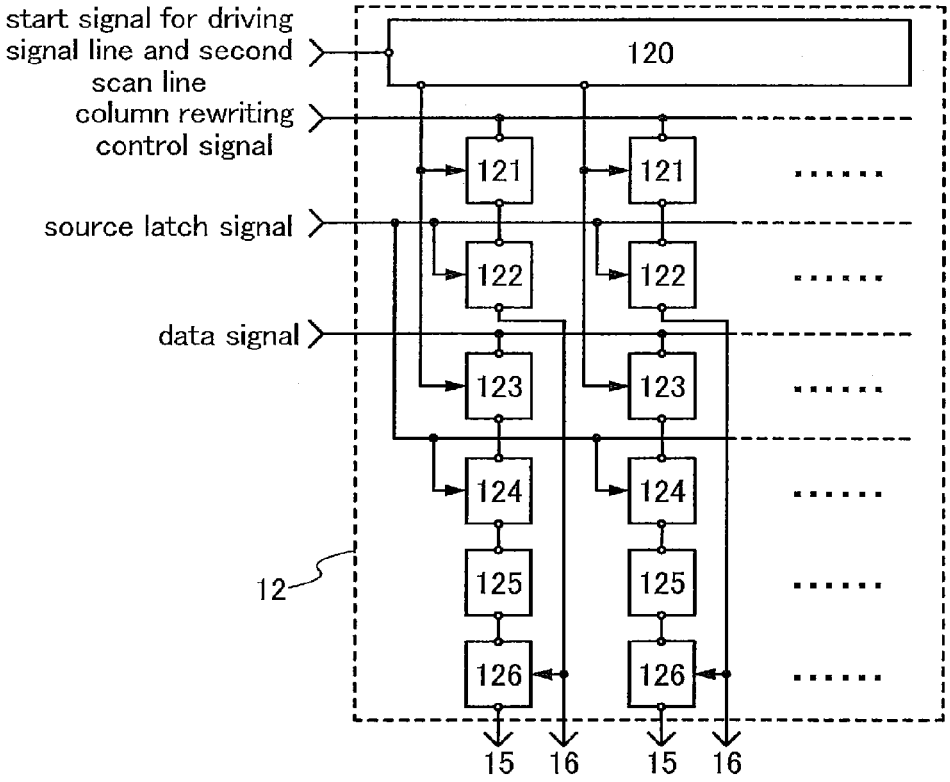
FIG. 2B is a diagram illustrating an example of a signal line and second scan line driver circuit.
Figure 7B:
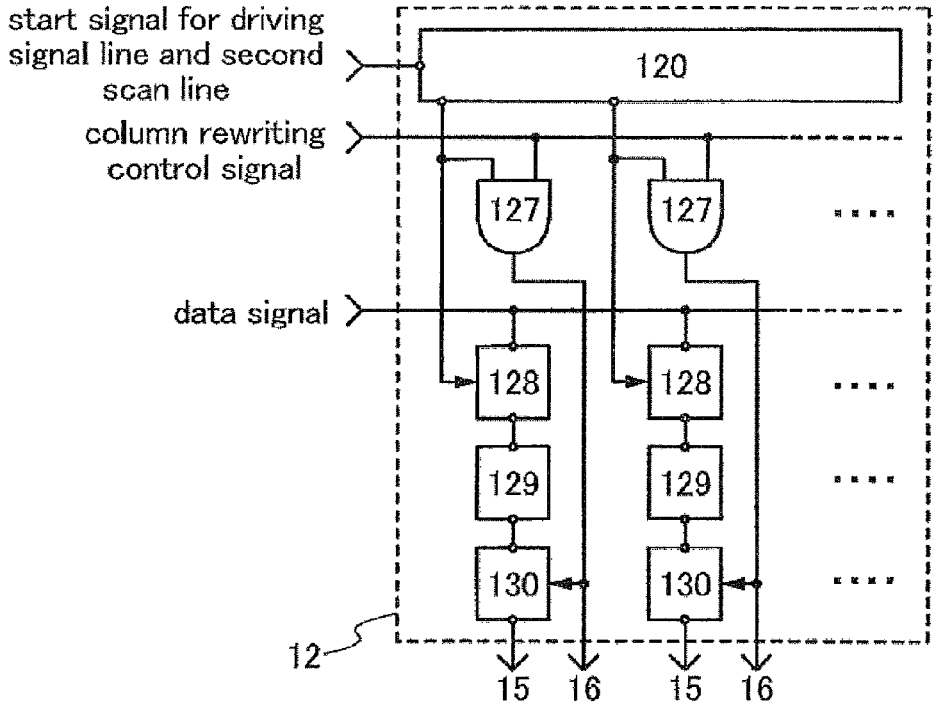
FIG. 7B is a diagram illustrating an example of a signal line and second scan line driver circuit.

The aforementioned display device has a configuration in which the signal line and second scan line driver circuit 12 includes the shift register 120, the latches 121, 122, 123, and 124, the digital to analog converter circuit (DAC) 125, and the analog buffer 126 (see FIG. 2B). Another configuration can also be employed in which the signal line and second scan line driver circuit 12 includes the shift register 120; an AND gate 127 whose first input terminal is electrically connected to any of the plurality of output terminals of the shift register 120, whose second input terminal is electrically connected to a wiring supplying a column rewriting control signal, and whose output terminal is electrically connected to any of the plurality of second scan lines 16; a latch 128 whose input terminal is electrically connected to a wiring supplying a data signal; a digital to analog converter circuit (DAC) 129 whose input terminal is electrically connected to an output terminal of the latch 128; and an analog buffer 130 whose input terminal is electrically connected to an output terminal of the digital to analog converter circuit (DAC) 129 and whose output terminal is electrically connected to any of the plurality of signal lines 15 (see FIG. 7B). Note that in the signal line and second scan line driver circuit 12 illustrated in FIG. 7B, the latch 128 is electrically connected to any of the plurality of output terminals of the shift register 120. The latch 128 has a function of retaining a data signal in a period during which a selection signal is supplied from the output terminal, and outputting the data signal. The digital to analog converter circuit (DAC) 129 has a function of converting a digital data signal input from the latch 128 into an analog signal, and outputting the analog signal. The analog buffer 130 has a function of selecting whether a data signal (an analog data signal) is supplied to the signal line 15, in accordance with the output signal of the AND gate 127 (a binary signal: a high-level signal or a low-level signal). Specifically, the analog buffer 130 supplies a data signal (an analog data signal) to the signal line 15 when the output signal of the AND gate 127 is a high-level signal, and does not supply a data signal (an analog data signal) to the signal line 15 when the output signal of the AND gate 127 is a low-level signal.

Figure 8A:
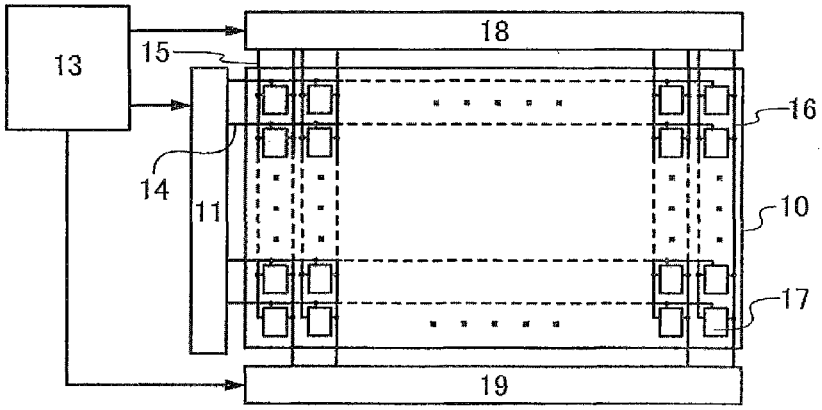
FIG. 8A is a diagram illustrating an example of a display device.
Figure 8B:
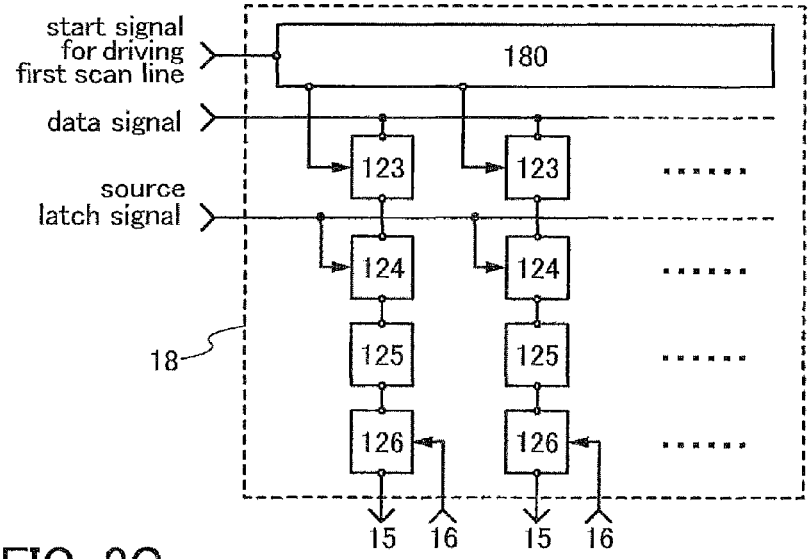
FIG. 8B is a diagram illustrating an example of a signal line driver circuit.
Figure 8C:
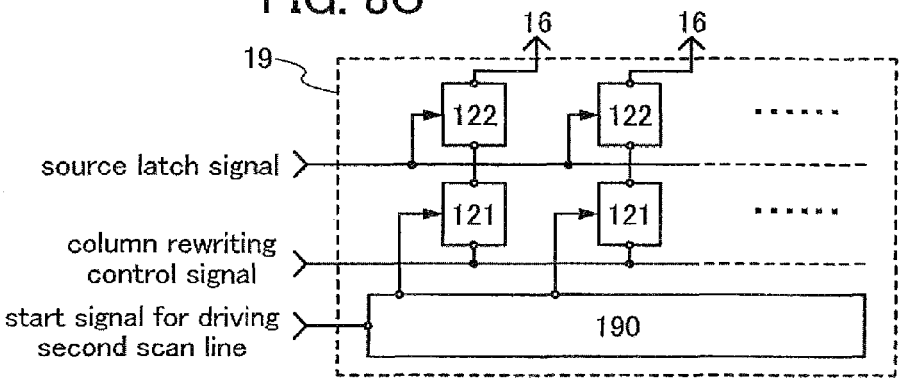
FIG. 8C is a diagram illustrating an example of a second scan line driver circuit.

Although the aforementioned display device has a configuration in which the plurality of signal lines 15 and the plurality of second scan lines 16 are driven by the signal line and second scan line driver circuit 12 (see FIG. 1A and FIG. 2B), another configuration can be employed in which the plurality of signal lines 15 and the plurality of second scan lines 16 are driven by different driver circuits (see FIG. 8A). In the display device illustrated in FIG. 8A, a signal line driver circuit 18 and a second scan line driver circuit 19 are used in instead of the signal line and second scan line driver circuit 12 included in the display device in FIG. 1A. For example, the signal line driver circuit 18 illustrated in FIG. 8A can include the latch 123, the latch 124, the digital to analog converter circuit (DAC) 125, the analog buffer 126, and a shift register for driving the signal line 180 having a plurality of output terminals (see FIG. 8B). The second scan line driver circuit 19 can include the latch 121, and the latch 122, and a shift register for driving the second scan line 190 having a plurality of output terminals (see FIG. 8C). Note that the shift register for driving the signal line 180 has a function of sequentially supplying selection signals from the plurality of output terminals when a start signal for driving the signal line is input from the outside. The shift register for driving the second scan line 190 has a function of sequentially supplying selection signals from the plurality of output terminals when a start signal for driving the second scan line is input from the outside.

(Example of Transistors 20 and 21 Included in Pixel 17)

Next, an example of the transistors 20 and 21 included in each pixel of the aforementioned display device will be described with reference to FIG. 9. Specifically, a transistor including an oxide semiconductor layer will be described. The oxide semiconductor layer of the transistor is highly purified, so that the off-current of the transistor can be extremely reduced (description will be made in detail below). Therefore, the transistor is preferably used for the transistors 20 and 21 included in each pixel of the display device which is disclosed in this specification and may have a specific pixel to which a data signal is not input for a long period.

Figure 9:
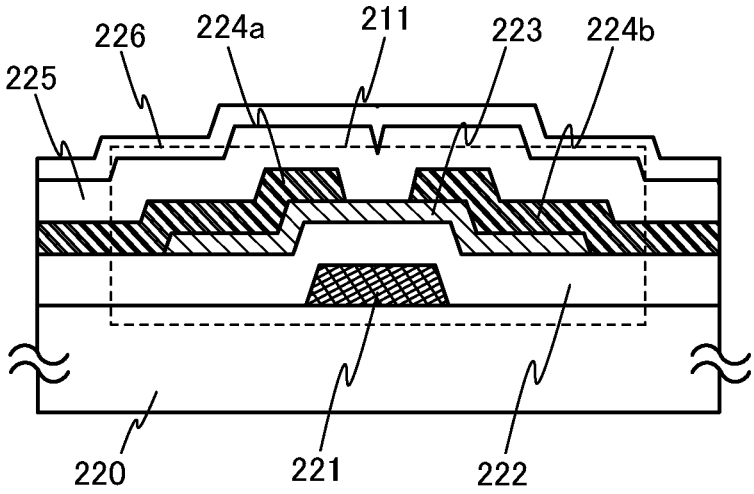
FIG. 9 is a cross-sectional view illustrating an example of a transistor.

The transistor 211 illustrated in FIG. 9 includes a gate layer 221 provided over a substrate 220 having an insulating surface, a gate insulating layer 222 provided over the gate layer 221, an oxide semiconductor layer 223 provided over the gate insulating layer 222, and a source layer 224*a* and a drain layer 224*b* provided over the oxide semiconductor layer 223. Further, in the transistor 211 illustrated in FIG. 9, an insulating layer 225 covering the transistor 211 is formed in contact with the oxide semiconductor layer 223, and a protective insulating layer 226 is formed over the insulating layer 225.

As described above, the transistor 211 illustrated in FIG. 9 includes the oxide semiconductor layer 223 as a semiconductor layer. As an oxide semiconductor used for the oxide semiconductor layer 223, the following can be used: an In—Sn—Ga—Zn—O-based oxide semiconductor which is a four-component metal oxide; an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor which are three-component metal oxides; an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, and an In—Mg—O-based oxide semiconductor which are two-component metal oxides; and an In—O-based oxide semiconductor, a Sn—O-based oxide semiconductor, and a Zn—O-based oxide semiconductor which are single-component metal oxides. Further, $SiO_2$ may be contained in the above oxide semiconductor. Here, for example, the In—Ga—Zn—O-based oxide semiconductor means an oxide containing at least In, Ga, and Zn, and the composition ratio of the elements is not particularly limited. The In—Ga—Zn—O-based oxide semiconductor may contain an element other than In, Ga, and Zn.

For the oxide semiconductor layer 223, a thin film represented by the chemical formula, $InMO_3(ZnO)_m$ (m>0), can be used. Here, M represents one or more metal elements selected from Ga, Al, Mn, and Co. For example, M can be Ga, Ga and Al, Ga and Mn, or Ga and Co.

In order to prevent variation in electrical characteristics of the aforementioned oxide semiconductor, an impurity that causes the variation, such as hydrogen, moisture, a hydroxyl group, or hydride (also referred to as a hydrogen compound), is intentionally removed, so that an electrically i-type (intrinsic) oxide semiconductor which is highly purified can be obtained.

Therefore, it is preferable that the oxide semiconductor contain as little hydrogen as possible. Further, the highly-purified oxide semiconductor has very few (close to zero) carriers which are derived from hydrogen, oxygen deficiency, and the like and the carrier density is less than $1\times10^{12}/cm^3$, preferably less than $1\times10^{11}/cm^3$. In other words, the density of carriers derived from hydrogen, oxygen deficiency, and the like in the oxide semiconductor layer is made as close to zero as possible. Since the oxide semiconductor layer has very few carriers derived from hydrogen, oxygen deficiency, and the like, the amount of leakage current when the transistor is off (off-current) can be reduced. In addition, a low level of the impurity derived from hydrogen, oxygen deficiency, and the like, allows reducing variation and deterioration of electrical characteristics due to light irradiation, temperature change, bias application, and the like. It is preferable that the off-current be as low as possible. The transistor using the above oxide semiconductor for a semiconductor layer, has a current value per micrometer of channel width (W) of 100 zA (zeptoampere) or less, preferably 10 zA or less, and more preferably 1 zA or less. Furthermore, because there is no pn junction and no hot carrier degradation, the electrical characteristics of the transistor are not adversely affected thereby.

If a channel formation region of a transistor uses such an oxide semiconductor which is highly purified by drastically removing hydrogen contained in the oxide semiconductor layer, the off-current of the transistor can be extremely reduced. In other words, the circuit can be designed while the oxide semiconductor layer is regarded as an insulator when the transistor is in a non-conducting state. On the other hand, when the transistor is in a conducting state, the current supply capability of the oxide semiconductor layer is expected to be higher than that of a semiconductor layer formed of amorphous silicon.

There is no particular limitation on the substrate that can be used as the substrate 220 having an insulating surface. For example, a glass substrate made of barium borosilicate glass or aluminoborosilicate glass can be used.

In the transistor 211, an insulating film serving as a base film may be provided between the substrate 220 and the gate layer 221. The base film has a function of preventing diffusion of an impurity element from the substrate, and can be formed to have a single-layer structure or a multi-layer structure using a silicon nitride film, a silicon oxide film, a silicon nitride oxide film, and/or a silicon oxynitride film.

The gate layer 221 can be formed as a single layer or stacked layers using a metal material such as molybdenum, titanium, chromium, tantalum, tungsten, aluminum, copper, neodymium, or scandium, or an alloy material which includes any of these materials as a main component.

The gate insulating layer 222 can be formed by plasma CVD, sputtering, or the like as a single layer or stacked layers of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, or a hafnium oxide layer. For example, a silicon nitride layer ($SiN_y$ (y>0)) with a thickness of 50 nm and to 200 nm is formed by plasma CVD as a first gate insulating layer, and a silicon oxide layer ($SiO_x$ (x>40)) with a thickness of 5 nm to 300 nm can be formed as a second gate insulating layer over the first gate insulating layer.

A conductive film used for the source layer 224*a* and the drain layer 224*b* can be formed using an element selected from Al, Cr, Cu, Ta, Ti, Mo, and W, an alloy including any of these elements as a component, an alloy film including a combination of any of these elements, or the like. The conductive film may have a structure in which a high-melting-point metal layer of Ti, Mo, W, or the like is stacked over and/or below a metal layer of Al, Cu, or the like. The heat resistance can be increased by using an Al material to which an element (e.g., Si, Nd, or Sc) which prevents generation of hillocks and whiskers in an Al film is added.

Alternatively, the conductive film used for the source layer 224*a* and the drain layer 224*b* (including a wiring layer formed using the same layer as the source layer 224*a* and the drain layer 224*b*) may be formed of a conductive metal oxide. As the conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials which contain silicon oxide can be used.

For the insulating layer 225, typically, an inorganic insulating film such as a silicon oxide film, a silicon oxynitride film, an aluminum oxide film, or an aluminum oxynitride film can be used.

For the protective insulating layer 226, an inorganic insulating film such as a silicon nitride film, an aluminum nitride film, a silicon nitride oxide film, or an aluminum nitride oxide film can be used.

A planarization insulating film may be formed over the protective insulating layer 226 in order to reduce the surface roughness caused by the transistor. The planarization insulating film can be formed of an organic material such as polyimide, acrylic, or benzocyclobutene. Other than such organic materials, it is also possible to use a low-dielectric constant material (a low-k material) or the like. Note that the planarization insulating film may be formed by stacking a plurality of insulating films formed of these materials.

(Off-Current of Transistor)

Next, results obtained by measurement of the off-current of a transistor including a highly-purified oxide semiconductor layer will be described.

Figure 10:
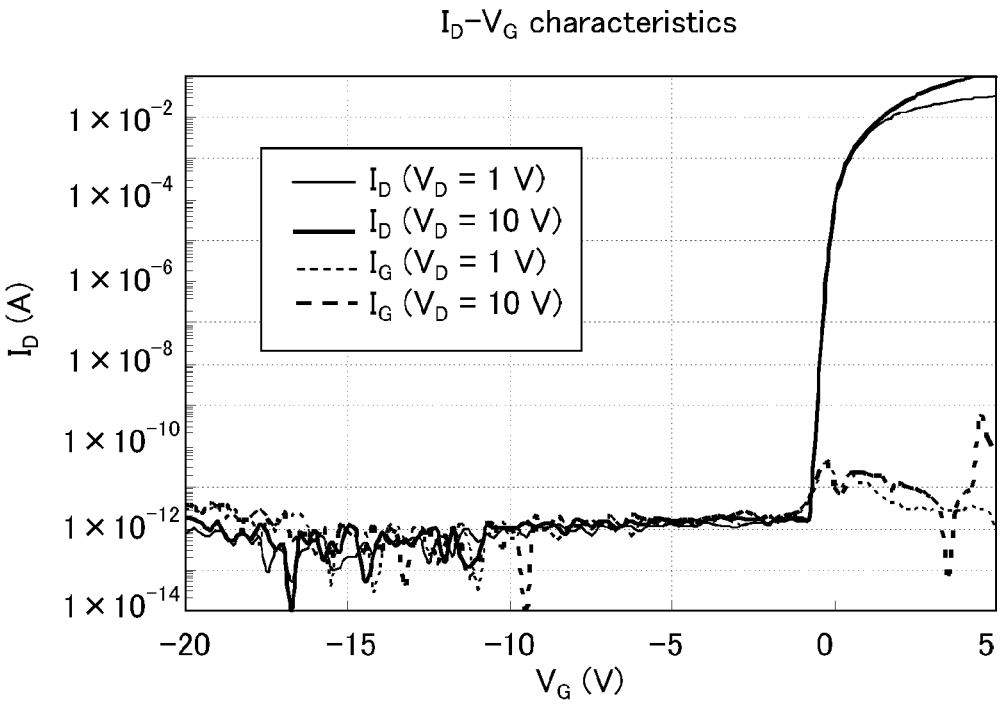
FIG. 10 is a graph illustrating the characteristics of a transistor.

First, in consideration of the fact that the off-current of a transistor including a highly-purified oxide semiconductor layer is extremely low, a transistor with a channel width W of as large as 1 m was prepared and then the off-current was measured. FIG. 10 shows the results of measuring the off-current of the transistor with a channel width W of 1 m. In FIG. 10, the horizontal axis represents a gate voltage VG and the vertical axis represents a drain current ID. In the case where the drain voltage VD is +1 V or +10 V and the gate voltage VG is in the range of −5 V to −20 V, the off-current of the transistor was found to be lower than or equal to $1\times10^{-12}$ A which is the detection limit. It was also found that the off-current of the transistor (per micrometer of channel width) is lower than or equal to 1 aA/μm ($1\times10^{-18}$ A/μm).

Next will be described the results obtained by more accurate measurement of the off-current of the transistor including a highly-purified oxide semiconductor layer. As described above, the off-current of the transistor including a highly-purified oxide semiconductor layer was found to be lower than or equal to $1\times10^{-12}$ A, which is the detection limit of the measurement equipment. Thus, an element for characteristic evaluation was manufactured to measure a more accurate off-current value (a value lower than or equal to the detection limit of measurement equipment in the above measurement); the results will be described.

First, the element for characteristic evaluation which was used in a method for measuring current will be described with reference to FIG. 11.

Figure 11:
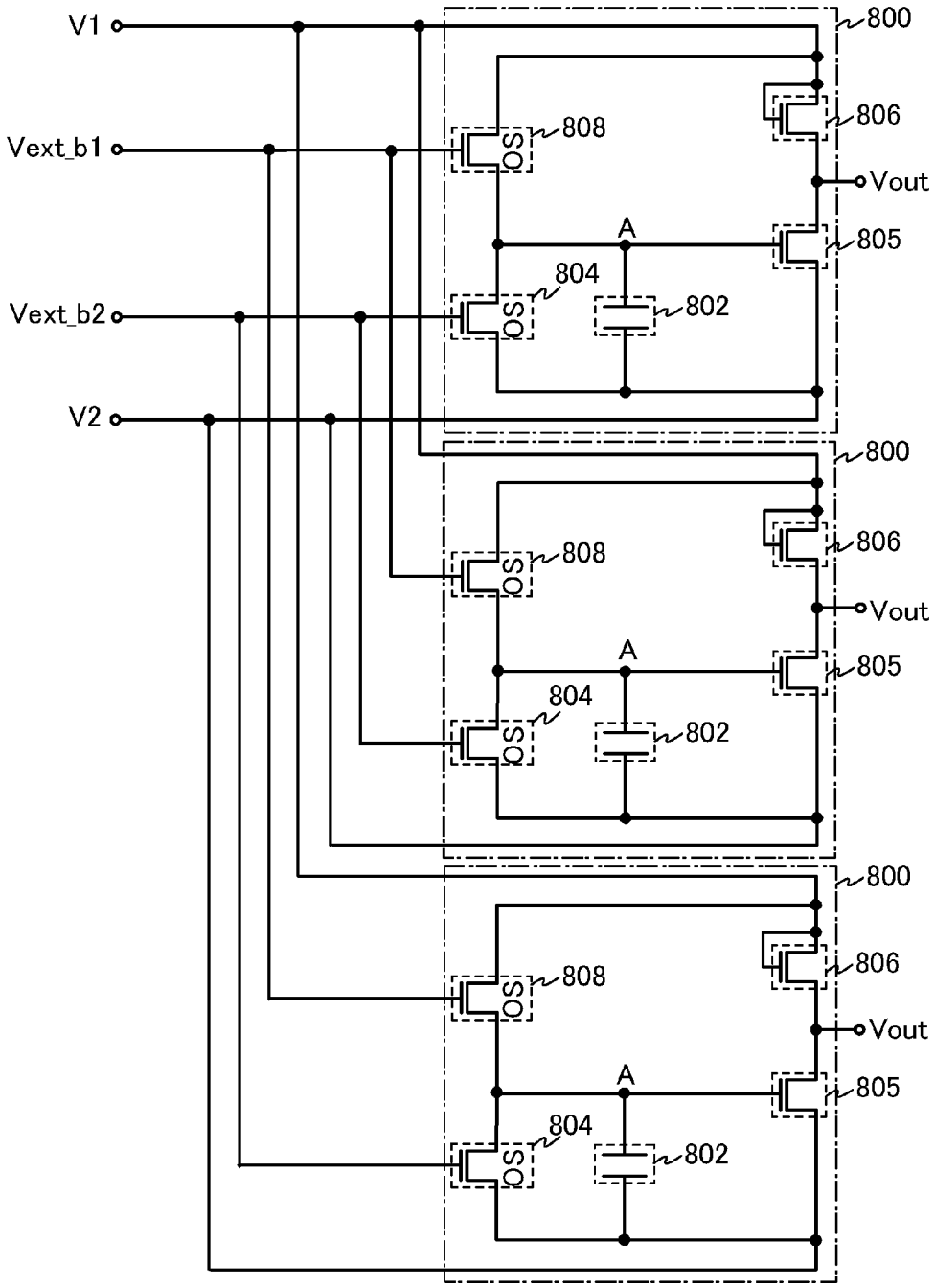
FIG. 11 is a diagram of a circuit for evaluating the characteristics of a transistor.

In the element for characteristic evaluation in FIG. 11, three measurement systems 800 are connected in parallel. The measurement system 800 includes a capacitor 802, a transistor 804, a transistor 805, a transistor 806, and a transistor 808. The transistor 804 and 808 includes a highly-purified oxide semiconductor layer.

In the measurement system 800, one of a source and a drain of the transistor 804, one terminal of the capacitor 802, and one of a source and a drain of the transistor 805 are connected to a power source (a power source for supplying V2). The other of the source and the drain of the transistor 804, one of a source and a drain of the transistor 808, the other terminal of the capacitor 802, and a gate of the transistor 805 are electrically connected to each another. The other of the source and the drain of the transistor 808, one of a source and a drain of the transistor 806, and a gate of the transistor 806 are electrically connected to a power source (a power source for supplying V1). The other of the source and the drain of the transistor 805 and the other of the source and the drain of the transistor 806 are electrically connected to an output terminal.

A potential Vext_b2 for controlling an on state and an off state of the transistor 804 is supplied to a gate of the transistor 804, and a potential Vext_b1 for controlling an on state and an off state of the transistor 808 is supplied to a gate of the transistor 808. A potential Vout is output from the output terminal.

Next, a method for measuring current with the use of the aforementioned element for characteristic evaluation will be described.

First, an initial period in which a potential difference is applied to measure the off-current will be briefly described. In the initial period, the potential Vext_b1 for turning on the transistor 808 is input to the gate of the transistor 808, and a potential V1 is applied to a node A that is a node electrically connected to the other of the source and the drain of the transistor 804 (that is, the node electrically connected to the one of the source and the drain of the transistor 808, the other terminal of the capacitor 802, and the gate of the transistor 805). Here, the potential V1 is, for example, a high potential, and the transistor 804 is off.

After that, the potential Vext_b1 for turning off the transistor 808 is input to the gate of the transistor 808, whereby the transistor 808 is turned off. After the transistor 808 is turned off, the potential V1 is set to a low potential. The transistor 804 is still off at this time. The potential V2 is the same potential as V1. Thus, the initial period is completed. When the initial period is finished, a potential difference is generated between the node A and the one of the source and the drain of the transistor 804. A potential difference is also generated between the node A and the other of the source and the drain of the transistor 808. Accordingly, a small amount of electric charge flows through the transistor 804 and the transistor 808. That is, the off-current is generated.

Next, a measurement period of the off-current is briefly described. In the measurement period, the potential of the one of the source and the drain of the transistor 804 (V2) and the potential of the other of the source and the drain of the transistor 808 (V1) are each fixed to a low potential. On the other hand, the potential of the node A is not fixed (is brought into a floating state) in the measurement period. Consequently, electric charge flows through the transistors 804 and 808 and the amount of charge held at the node A changes as time goes by. The potential of the node A changes depending on a change in the amount of charge held at the node A. That is, the output potential Vout of the output terminal also varies.

Figure 12:
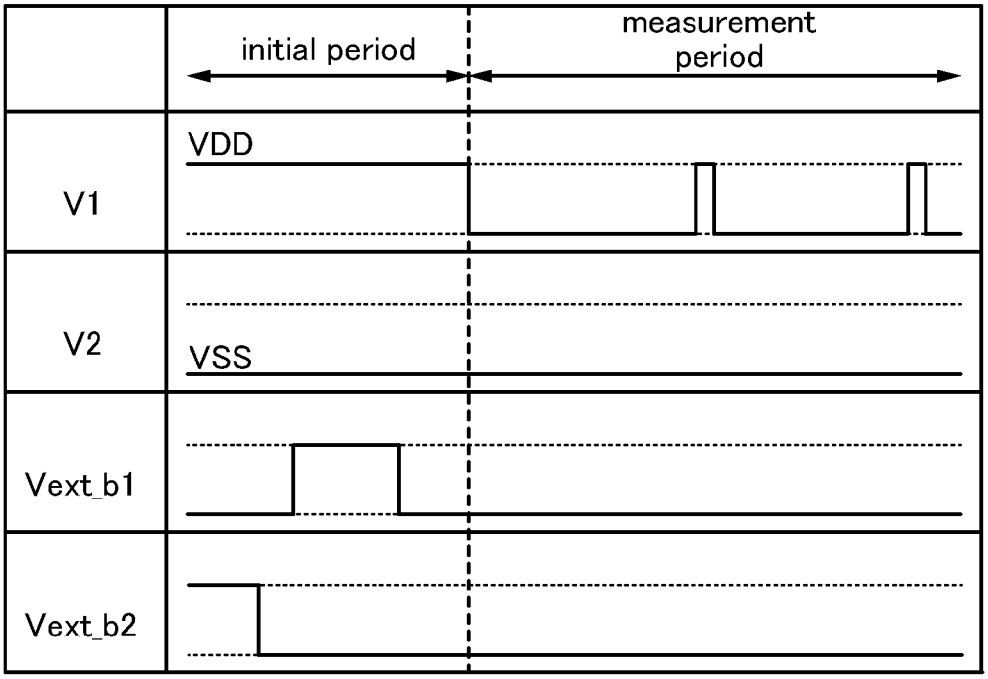
FIG. 12 is a timing chart for evaluating the characteristics of a transistor.

FIG. 12 illustrates details (timing chart) of the relationship between the potentials in the initial period in which the potential difference is applied and in the following measurement period.

In the initial period, first, the potential Vext_b2 is set to a potential at which the transistor 804 is turned on (a high potential). Thus, the potential of the node A becomes V2, namely, a low potential (VSS). Note that a low potential (VSS) is not necessarily applied to the node A. After that, the potential Vext_b2 is set to a potential at which the transistor 804 is turned off (a low potential), whereby the transistor 804 is turned off. Next, the potential Vext_b1 is set to a potential at which the transistor 808 is turned on (a high potential). Thus, the potential of the node A becomes V1, namely, a high potential (VDD). After that, the potential Vext_b1 is set to a potential at which the transistor 808 is turned off. Consequently, the node A is brought into a floating state and the initial period is completed.

In the following measurement period, the potential V1 and the potential V2 are set to a potential at which charge flows to or from the node A. Here, the potential V1 and the potential V2 are set to a low potential (VSS). Note that at the timing of measuring the output potential Vout, it is necessary to operate an output circuit; therefore, the potential V1 is temporarily set to a high potential (VDD) in some cases. The period during which the potential V1 is a high potential (VDD) is made short enough not to influence the measurement.

When the potential difference is generated in the aforementioned manner and the measurement period is started, the amount of charge held at the node A changes as time passes, and the potential of the node A changes accordingly. This means that the potential of the gate of the transistor 805 varies and thus, the output potential Vout of the output terminal also varies with time.

A method for calculating the off-current on the basis of the obtained output potential Vout will be described below.

The relationship between the potential VA of the node A and the output potential Vout is obtained in advance before the off-current is calculated. With this, the potential VA of the node A can be obtained from the output potential Vout. In accordance with the above relationship, the potential VA of the node A can be expressed by the following equation as a function of the output potential Vout.

$$V_A = F(V\text{out}) \qquad \text{[FORMULA 1]}$$

Electric charge QA of the node A can be expressed by the following equation with the use of the potential VA of the node A, capacitance CA connected to the node A, and a constant (const). Here, the capacitance CA connected to the node A is the sum of the capacitance of the capacitor 802 and other capacitance.

$$Q_A = C_A V_A + \text{const} \qquad \text{[FORMULA 2]}$$

Since a current IA of the node A is obtained by differentiating electric charge flowing to the node A (or electric charge flowing from the node A) with respect to time, the current IA of the node A is expressed by the following equation.

$$I_A \equiv \frac{\Delta Q_A}{\Delta t} = \frac{C_A \cdot \Delta F(Vout)}{\Delta t} \qquad \text{[FORMULA 3]}$$

In this manner, the current IA of the node A can be obtained from the capacitance CA connected to the node A and the output potential Vout of the output terminal.

With the above method, it is possible to measure the leakage current (the off-current) which flows between a source and a drain of a transistor in an off state.

Manufactured here were the transistor 804 and the transistor 808 each having a channel length L of 10 μm and a channel width W of 50 μm and including a highly-purified oxide semiconductor layer. In the measurement systems 800 arranged in parallel, the capacitance values of the capacitors 802 were 100 fF, 1 pF, and 3 pF.

Note that in the aforementioned measurement, VDD was 5 V and VSS was 0 V. In the measurement period, the potential V1 was basically set to VSS and was set to VDD only in a period of 100 msec every 10 sec. to 300 sec., and Vout was measured. Δt which was used in calculation of the current I flowing through the element was about 30000 sec.

Figure 13:
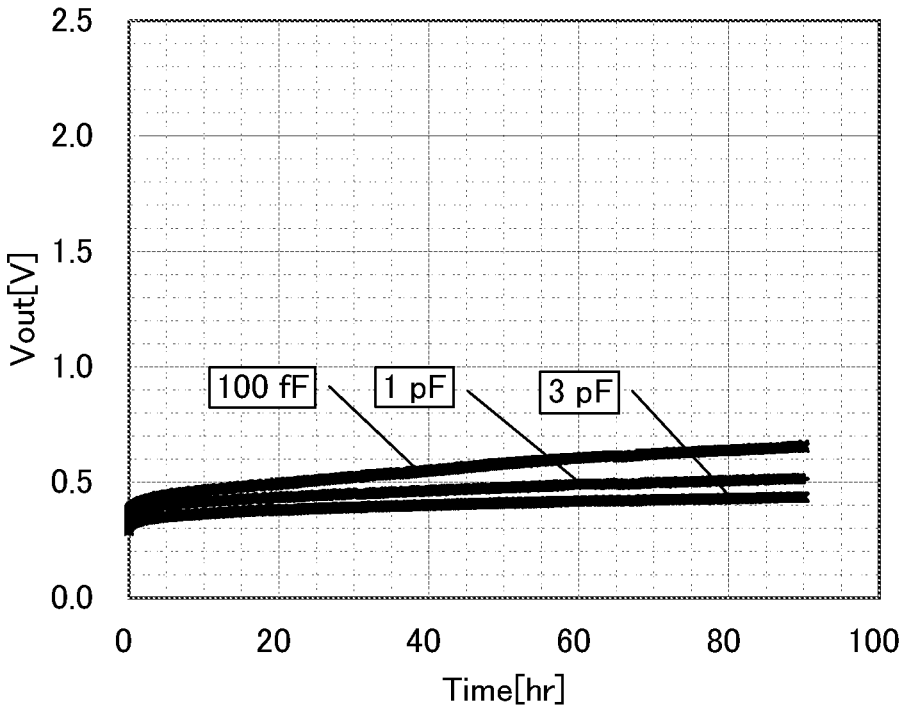
FIG. 13 is a graph illustrating the characteristics of a transistor.

FIG. 13 illustrates the relationship between elapsed time Time and the output potential Vout in the above current measurement. FIG. 13 shows that the potential varies as time passes.

Figure 14:
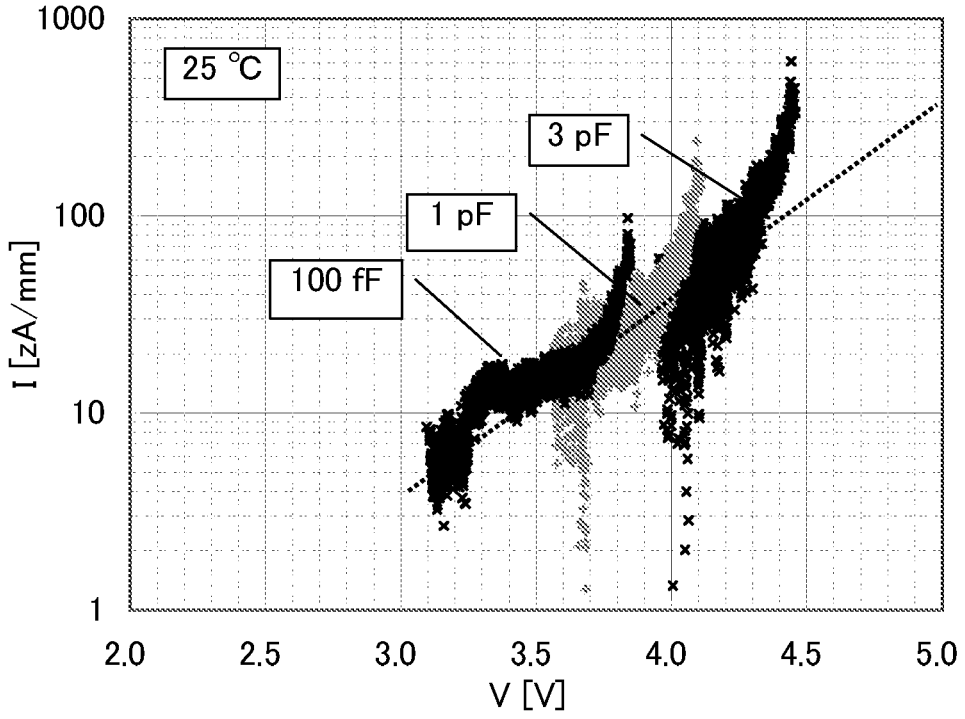
FIG. 14 is a graph illustrating the characteristics of a transistor.

FIG. 14 illustrates the off-current at room temperature (25° C.) calculated on the basis of the above current measurement. Note that FIG. 14 illustrates the relationship between a source-drain voltage V and an off-current I of the transistor 804 or the transistor 808. FIG. 14 shows that the off-current was about 40 zA/μm under the condition where the source-drain voltage was 4 V. Under the condition where the source-drain voltage was 3.1 V, the off-current was lower than or equal to 10 zA/μm. Note that 1 zA represents $10^{-21}$ A.

Figure 15:
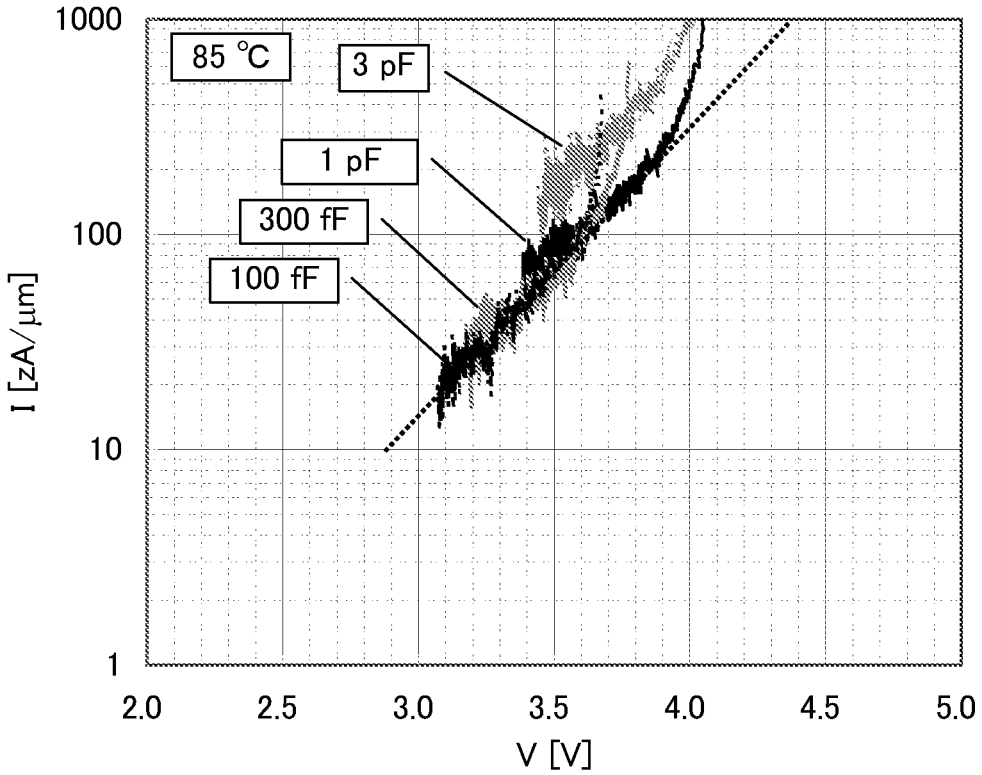
FIG. 15 is a graph illustrating the characteristics of a transistor.

Further, FIG. 15 illustrates the off-current in a temperature environment of 85° C., which was calculated in the above current measurement. FIG. 15 illustrates the relationship between a source-drain voltage V and an off-current I of the transistor 804 or the transistor 808 in a temperature environment of 85° C. FIG. 15 shows that the off-current was lower than or equal to 100 zA/μm under the condition where the source-drain voltage was 3.1 V.

As described above, it was confirmed that a transistor including a highly-purified oxide semiconductor layer had a sufficiently low off-current.

(Modified Example of Transistors 20 and 21 Included in Pixel 17)

In the aforementioned display device, the bottom-gate transistor 211 called a channel-etched transistor is used for the transistors 20 and 21 provided in each pixel (see FIG. 9); however, the structure of the transistors 20 and 21 is not limited to this. For example, transistors illustrated in FIGS. 16A to 16C can be employed.

Figure 16A:
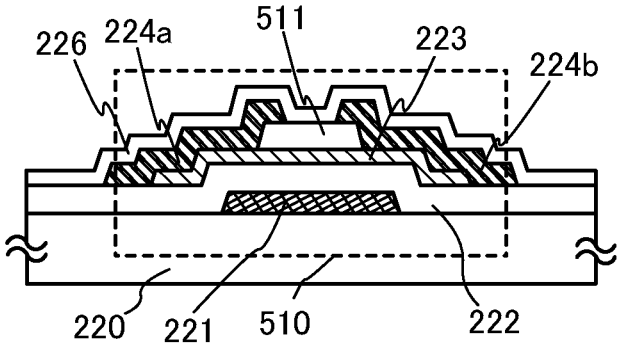
FIGS. 16A to 16C are cross-sectional views each illustrating an example of a transistor.

A transistor 510 illustrated in FIG. 16A is one of bottom-gate transistors called a channel-protective type (also referred to as a channel-stop type) transistor.

The transistor 510 includes, over the substrate 220 having an insulating surface, the gate layer 221, the gate insulating layer 222, the oxide semiconductor layer 223, an insulating layer 511 functioning as a channel protective layer covering a channel formation region of the oxide semiconductor layer 223, the source layer 224*a*, and the drain layer 224*b*. Further, the protective insulating layer 226 is formed to cover the source layer 224*a*, the drain layer 224*b*, and the insulating layer 511.

Figure 16B:
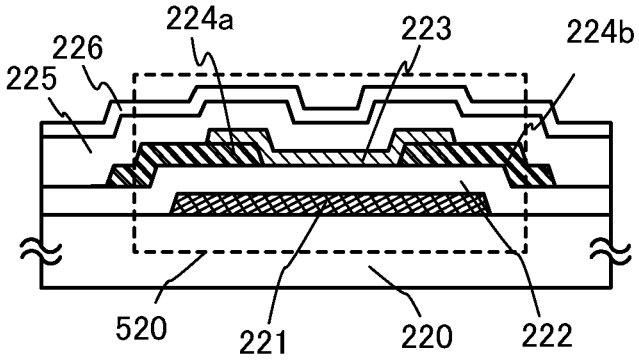

A transistor 520 illustrated in FIG. 16B is a bottom-gate transistor. The transistor 520 includes, over the substrate 220 having an insulating surface, the gate layer 221, the gate insulating layer 222, the source layer 224*a*, the drain layer 224*b*, and the oxide semiconductor layer 223. Further, the insulating layer 225 covering the source layer 224*a* and the drain layer 224*b* is provided in contact with the oxide semiconductor layer 223. The protective insulating layer 226 is further provided over the insulating layer 225.

In the transistor 520, the gate insulating layer 222 is provided on and in contact with the substrate 220 and the gate layer 221, and the source layer 224*a* and the drain layer 224*b* are provided on and in contact with the gate insulating layer 222. The oxide semiconductor layer 223 is provided over the gate insulating layer 222, the source layer 224*a*, and the drain layer 224*b*.

Figure 16C:
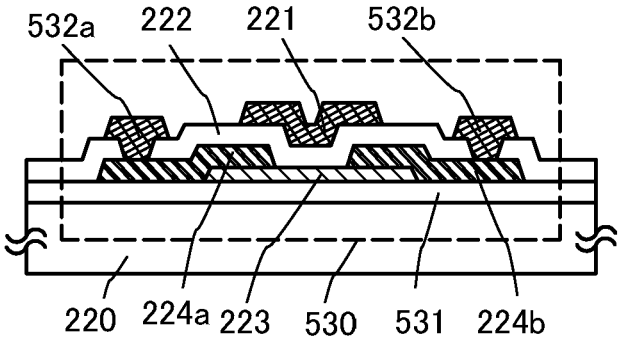

The transistor 530 illustrated in FIG. 16C is one of top-gate transistors. The transistor 530 includes, over the substrate 220 having an insulating surface, an insulating layer 531, the oxide semiconductor layer 223, the source layer 224*a*, the drain layer 224*b*, the gate insulating layer 222, and the gate layer 221. A wiring layer 532*a* and a wiring layer 532*b* are provided to be in contact with and electrically connected to the source layer 224*a* and the drain layer 224*b*, respectively.

For the insulating layers 511 and 531, typically, an inorganic insulating film such as a silicon oxide film, a silicon oxynitride film, an aluminum oxide film, or an aluminum oxynitride film can be used. As a conductive film used for the wiring layer 532*a* and the wiring layer 532*b*, an element selected from Al, Cr, Cu, Ta, Ti, Mo, and W, an alloy including any of these elements as a component, an alloy film including a combination of any of these elements, or the like can be used. The conductive film may have a structure in which a high-melting-point metal layer of Ti, Mo, W, or the like is stacked over and/or below a metal layer of Al, Cu, or the like. The heat resistance can be increased by using an Al material to which an element (e.g., Si, Nd, or Sc) which prevents generation of hillocks and whiskers in an Al film is added.

(Example of Manufacturing Process of Transistors 20 and 21 Included in Pixel 17)

Figure 17A:
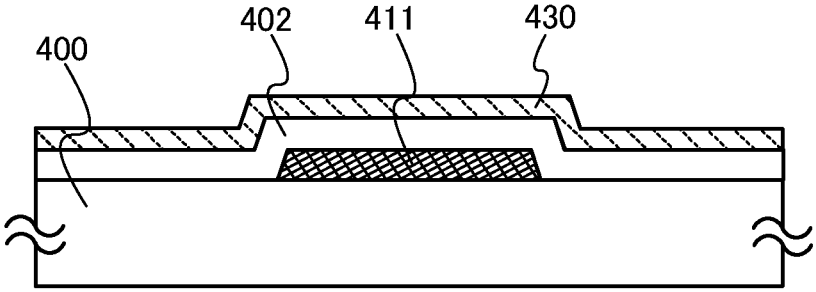
FIGS. 17A to 17D are cross-sectional views illustrating an example of a manufacturing process of a transistor.
Figure 17B:
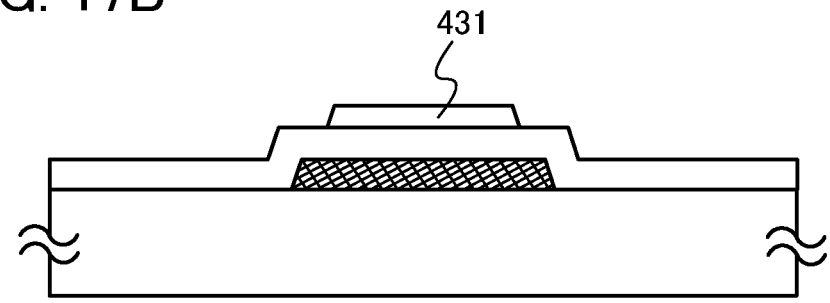
Figure 17C:
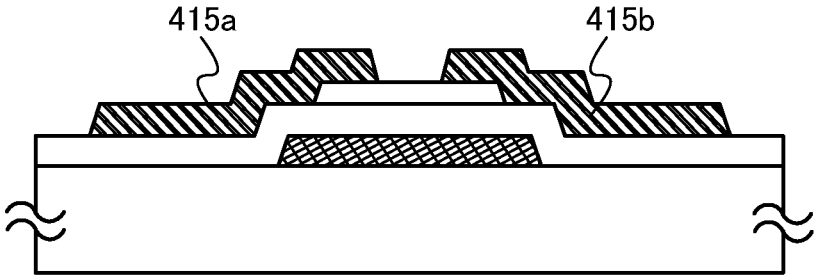
Figure 17D:
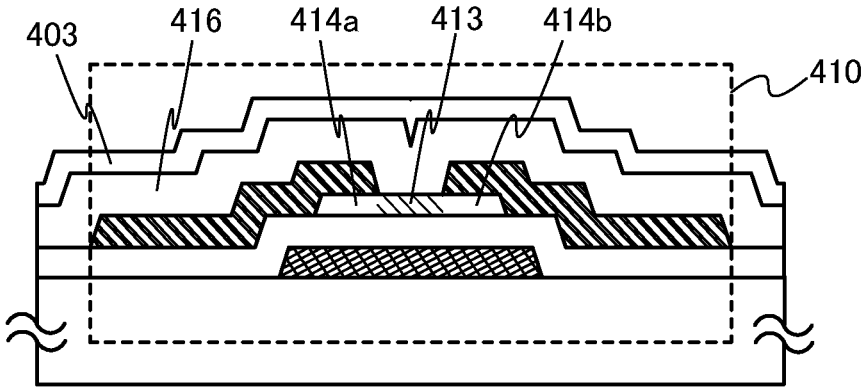

Described below is an example of the manufacturing process of the transistors 20 and 21 provided in each pixel of the display device disclosed in this specification. Specifically, a manufacturing process of a channel-etched transistor 410 which is a kind of bottom-gate transistors will be described with reference to FIGS. 17A to 17D. Although a single-gate transistor is illustrated in FIG. 17D, a multi-gate transistor including a plurality of channel formation regions can be formed as needed.

A process for manufacturing the transistor 410 over a substrate 400 will be described below with reference to FIGS. 17A to 17D.

First, a conductive film is formed over the substrate 400 having an insulating surface; then, a gate layer 411 is formed in a first photolithography step. Note that a resist mask used in this step may be formed by an inkjet method. In the case of forming a resist mask by an inkjet method, the manufacturing cost can be reduced because a photomask is not used.

Although there is no particular limitation on the substrate which can be used as the substrate 400 having an insulating surface, it is necessary that the substrate have heat resistance enough to withstand at least heat treatment performed later. For example, a glass substrate made of barium borosilicate glass or aluminoborosilicate glass can be used. In the case where the later heat treatment is performed at high temperature, a glass substrate having a strain point of 730° C. or higher is preferably used.

An insulating layer functioning as a base layer may be provided between the substrate 400 and the gate layer 411. The base layer has a function of preventing diffusion of an impurity element from the substrate 400, and can be formed to have a single-layer structure or a multi-layer structure using a silicon nitride film, a silicon oxide film, a silicon nitride oxide film, and/or a silicon oxynitride film.

The gate layer 411 can be formed as a single layer or stacked layers using a metal material such as molybdenum, titanium, chromium, tantalum, tungsten, aluminum, copper, neodymium, or scandium, or an alloy material which includes any of these materials as a main component.

As a two-layer structure of the gate layer 411, for example, the following two-layer structures are preferably used: a structure in which a molybdenum layer is stacked over an aluminum layer; a structure in which a molybdenum layer is stacked over a copper layer; a structure in which a titanium nitride layer or a tantalum nitride layer is stacked over a copper layer; and a structure in which a titanium nitride layer and a molybdenum layer are stacked. As a three-layer structure, it is preferable that a tungsten layer or a tungsten nitride layer, a layer of an alloy of aluminum and silicon or an alloy of aluminum and titanium, and a titanium nitride layer or a titanium layer be stacked.

Then, a gate insulating layer 402 is formed over the gate layer 411.

The gate insulating layer 402 can be formed by plasma CVD, sputtering, or the like as a single layer or stacked layers using a silicon oxide layer, a silicon nitride layer, a silicon oxynitride layer, a silicon nitride oxide layer, or an aluminum oxide layer. For example, a silicon oxynitride layer may be formed by plasma CVD using a deposition gas containing silane ($SiH_4$), oxygen, and nitrogen. Furthermore, a high-k material such as hafnium oxide ($HfO_x$) or tantalum oxide ($TaO_x$) can be used for the gate insulating layer 402. The gate insulating layer 402 has a thickness of 100 nm to 500 nm inclusive; in the case where the gate insulating layer 402 has a multi-layer structure, for example, a first gate insulating layer with a thickness of 50 nm to 200 nm inclusive and a second gate insulating layer with a thickness of 5 nm to 300 nm inclusive are stacked.

Here, a silicon oxynitride layer with a thickness of 100 nm or less is formed as the gate insulating layer 402 by plasma CVD.

Moreover, as the gate insulating layer 402, a silicon oxynitride layer may be formed with a high-density plasma apparatus. Here, the high-density plasma apparatus refers to an apparatus which can realize a plasma density of $1\times10^{11}/cm^3$ or more. For example, plasma is generated by application of a microwave power of 3 kW to 6 kW, and an insulating layer is formed.

A silane gas ($SiH_4$), nitrous oxide ($N_2O$), and a rare gas are introduced as a source gas into a chamber to generate high-density plasma at a pressure of 10 Pa to 30 Pa, and the insulating layer is formed over the substrate having an insulating surface, such as a glass substrate. After that, the supply of silane ($SiH_4$) is stopped, and plasma treatment may be performed on a surface of the insulating layer by introducing nitrous oxide ($N_2O$) and a rare gas without exposure to the air. The plasma treatment performed on the surface of the insulating layer by introducing at least nitrous oxide ($N_2O$) and a rare gas is performed after the insulating layer is formed. The insulating layer formed through the above process has a small thickness and is an insulating layer whose reliability can be ensured even though, for example, it has a thickness of less than 100 nm.

In forming the gate insulating layer 402, the flow rate ratio of silane ($SiH_4$) to nitrous oxide ($N_2O$) which are introduced into the chamber is in the range of 1:10 to 1:200. As the rare gas introduced into the chamber, helium, argon, krypton, xenon, or the like can be used. In particular, argon, which is inexpensive, is preferably used.

In addition, since the insulating layer formed using the high-density plasma apparatus can have a uniform thickness, the insulating layer has excellent step coverage. Further, with the high-density plasma apparatus, the thickness of a thin insulating layer can be controlled precisely.

The insulating layer formed through the above process is greatly different from an insulating layer formed using a conventional parallel plate plasma CVD apparatus. The etching rate of the insulating layer formed through the above process is lower than that of the insulating layer formed with the conventional parallel plate plasma CVD apparatus by 10% or more or 20% or more in the case where the etching rates with the same etchant are compared to each other. Thus, it can be said that the insulating layer formed using the high-density plasma apparatus is a dense film.

Note that the oxide semiconductor that becomes an i-type or substantially i-type oxide semiconductor (a highly-purified oxide semiconductor) in a later step is extremely sensitive to the interface state density or interface electric charge; therefore, the interface with the gate insulating layer is important. For that reason, the gate insulating layer that is to be in contact with a highly-purified oxide semiconductor needs to have high quality. A high-density plasma CVD apparatus with use of microwaves (2.45 GHz) is preferably employed because a dense and high-quality insulating film having high withstand voltage can be formed. When the highly-purified oxide semiconductor and the high-quality gate insulating layer are in close contact with each other, the interface state density can be reduced and favorable interface characteristics can be obtained. It is important for the gate insulating layer not only to have favorable film quality as a gate insulating layer, but also to have lower interface state density with an oxide semiconductor to form a favorable interface.

Then, an oxide semiconductor film 430 with a thickness of 2 nm to 200 nm inclusive is formed over the gate insulating layer 402. Note that before the oxide semiconductor film 430 is formed by sputtering, powdery substances (also referred to as particles or dust) attached on a surface of the gate insulating layer 402 are preferably removed by reverse sputtering in which an argon gas is introduced and plasma is generated. The reverse sputtering refers to a method in which, without application of voltage to a target side, an RF power source is used for application of voltage to a substrate side in an argon atmosphere to generate plasma in the vicinity of the substrate to modify a surface. Note that instead of an argon atmosphere, a nitrogen atmosphere, a helium atmosphere, an oxygen atmosphere, or the like may be used.

As the oxide semiconductor film 430, an In—Ga—Zn—O-based oxide semiconductor film, an In—Sn—O-based oxide semiconductor film, an In—Sn—Zn—O-based oxide semiconductor film, an In—Al—Zn—O-based oxide semiconductor film, a Sn—Ga—Zn—O-based oxide semiconductor film, an Al—Ga—Zn—O-based oxide semiconductor film, a Sn—Al—Zn—O-based oxide semiconductor film, an In—Zn—O-based oxide semiconductor film, a Sn—Zn—O-based oxide semiconductor film, an Al—Zn—O-based oxide semiconductor film, an In—O-based oxide semiconductor film, a Sn—O-based oxide semiconductor film, or a Zn—O-based oxide semiconductor film is used. Here, the oxide semiconductor film 430 is formed by sputtering with the use of an In—Ga—Zn—O-based metal oxide target. A cross-sectional view in this step is illustrated in FIG. 17A. Alternatively, the oxide semiconductor film 430 can be formed by sputtering in a rare gas (typically argon) atmosphere, an oxygen atmosphere, or a mixed atmosphere containing a rare gas (typically argon) and oxygen. Note that when a sputtering method is employed, deposition can be performed using a target containing $SiO_2$ at 2 wt % to 10 wt % inclusive so that $SiO_x$ (x>0) which inhibits crystallization is contained in the oxide semiconductor film 430, whereby crystallization at a later step of heat treatment for dehydration or dehydrogenation can be prevented.

In the case where an In—Zn—O-based material is used as the oxide semiconductor, a target used has a composition ratio of In:Zn=50:1 to 1:2 in an atomic ratio ($In_2O_3$:ZnO=25:1 to 1:4 in a molar ratio), preferably In:Zn=20:1 to 1:1 in an atomic ratio ($In_2O_3$:ZnO=10:1 to 1:2 in a molar ratio), and further preferably In:Zn=15:1 to 1.5:1 ($In_2O_3$:ZnO=15:2 to 3:4 in a molar ratio). For example, in a target used for forming an In—Zn—O-based oxide semiconductor which has an atomic ratio of In:Zn:O=X:Y:Z, a relation of Z>1.5X+Y is satisfied.

Here, deposition is performed using a metal oxide target containing In, Ga, and Zn ($In_2O_3$:$Ga_2O_3$:ZnO=1:1:1 [mol] and In:Ga:Zn=1:1:0.5 [atom]). The deposition conditions are as follows: the distance between the substrate and the target is 100 mm; the pressure is 0.2 Pa; the direct current (DC) power is 0.5 kW; and the atmosphere contains argon and oxygen (argon:oxygen=30 sccm:20 sccm and the flow rate ratio of oxygen is 40%). Note that a pulse direct current (DC) power is preferably used because powder substances generated at the time of deposition can be reduced and the film thickness can be made uniform. Here, as the oxide semiconductor film, a 20-nm-thick In—Ga—Zn—O-based film is formed by sputtering with the use of an In—Ga—Zn—O-based metal oxide target. As the metal oxide target containing In, Ga, and Zn, a metal oxide target having a composition ratio of In:Ga:Zn=1:1:1 [atom] or In:Ga:Zn=1:1:2 [atom] can also be used.

Examples of a sputtering method include RF sputtering in which a high-frequency power is used as a sputtering power source, DC sputtering, and pulsed DC sputtering in which a bias is applied in a pulsed manner. The RF sputtering is mainly used for forming an insulating film, and the DC sputtering is mainly used for forming a metal film.

There is also a multi-source sputtering apparatus in which a plurality of targets of different materials can be set. With the multi-source sputtering apparatus, films of different materials can be stacked in the same chamber, or a film of plural kinds of materials can be formed by electric discharge at the same time in the same chamber.

In addition, there are a sputtering apparatus provided with a magnet system inside the chamber and used for magnetron sputtering, and a sputtering apparatus used for ECR sputtering in which plasma generated with the use of microwaves is used without using glow discharge.

Furthermore, as a deposition method by sputtering, there are also reactive sputtering in which a target substance and a sputtering gas component are chemically reacted with each other during deposition to form a thin compound film thereof, and bias sputtering in which a voltage is also applied to a substrate during deposition.

Then, the oxide semiconductor film 430 is processed into an island-shaped oxide semiconductor layer in a second photolithography step. A resist mask used in this step may be formed by an inkjet method. In the case of forming a resist mask by an inkjet method, the manufacturing cost can be reduced because a photomask is not used.

Note that the etching of the oxide semiconductor film 430 is not limited to wet etching and dry etching may also be used.

As the etching gas for dry etching, a gas containing chlorine (a chlorine-based gas such as chlorine ($Cl_2$), boron trichloride ($BCl_3$), silicon tetrachloride ($SiCl_4$), or carbon tetrachloride ($CCl_4$)) is preferably used.

Alternatively, a gas containing fluorine (a fluorine-based gas such as carbon tetrafluoride ($CF_4$), sulfur hexafluoride ($SF_6$), nitrogen trifluoride ($NF_3$), or trifluoromethane ($CHF_3$)); hydrogen bromide (HBr); oxygen ($O_2$); any of these gases to which a rare gas such as helium (He) or argon (Ar) is added; or the like can be used.

As the dry etching, parallel plate RIE (reactive ion etching) or ICP (inductively coupled plasma) etching can be used. In order to etch the film into a desired shape, the etching conditions (the amount of electric power applied to a coil-shaped electrode, the amount of electric power applied to an electrode on a substrate side, the temperature of the electrode on the substrate side, or the like) are adjusted as appropriate.

After the wet etching, the etchant is removed together with the etched materials by cleaning. The waste liquid including the etchant and the etched materials may be purified so that the materials are reused. When a material such as indium included in the oxide semiconductor layer is collected from the waste liquid after the etching and reused, the resources can be efficiently used and the cost can be reduced.

The etching conditions (such as an etchant, etching time, and temperature) are appropriately adjusted depending on the material so that a film can be etched into a desired shape.

Next, dehydration or dehydrogenation of the oxide semiconductor layer is performed. The temperature of first heat treatment for dehydration or dehydrogenation is higher than or equal to 400° C. and lower than or equal to 750° C., preferably higher than or equal to 400° C. and lower than the strain point of the substrate. Here, the substrate is introduced into an electric furnace which is a kind of heat treatment apparatus, heat treatment is performed on the oxide semiconductor layer in a nitrogen atmosphere at 450° C. for one hour, and then, the oxide semiconductor layer is not exposed to the air so that entry of water and hydrogen into the oxide semiconductor layer is prevented; thus, an oxide semiconductor layer 431 is obtained (see FIG. 17B).

Note that a heat treatment apparatus is not limited to an electrical furnace, and may include a device for heating an object to be processed by heat conduction or heat radiation from a heating element such as a resistance heating element. For example, an RTA (rapid thermal anneal) apparatus such as a GRTA (gas rapid thermal anneal) apparatus or an LRTA (lamp rapid thermal anneal) apparatus can be used. The LRTA apparatus is an apparatus for heating an object to be processed by radiation of light (an electromagnetic wave) emitted from a lamp such as a halogen lamp, a metal halide lamp, a xenon arc lamp, a carbon arc lamp, a high-pressure sodium lamp, or a high-pressure mercury lamp. The GRTA apparatus is an apparatus for heat treatment using a high-temperature gas. As the gas, an inert gas which does not react with an object to be processed by heat treatment, like nitrogen or a rare gas such as argon is used.

For example, as the first heat treatment, GRTA may be performed in which the substrate is moved into an inert gas heated to a temperature as high as 650° C. to 700° C., heated for several minutes, and moved out of the inert gas heated to the high temperature. With GRTA, high-temperature heat treatment in a short period of time is enabled.

Note that in the first heat treatment, it is preferable that water, hydrogen, and the like be not contained in the atmosphere of nitrogen or a rare gas such as helium, neon, or argon. It is preferable that the purity of nitrogen or the rare gas such as helium, neon, or argon which is introduced into a heat treatment apparatus be set to 6N (99.9999%) or higher, preferably 7N (99.99999%) or higher (that is, the impurity concentration is lower than or equal to 1 ppm, preferably lower than or equal to 0.1 ppm).

The first heat treatment of the oxide semiconductor layer may be performed on the oxide semiconductor film 430 before being processed into the island-shaped oxide semiconductor layer. In that case, after the first heat treatment, the substrate is taken out from the heat treatment apparatus, and then the second photolithography step is performed.

The heat treatment for dehydration or dehydrogenation of the oxide semiconductor layer may be performed at any of the following timings: after the oxide semiconductor layer is formed; after a source electrode layer and a drain electrode layer are formed over the oxide semiconductor layer; and after a protective insulating film is formed over the source electrode layer and the drain electrode layer.

In the case where an opening portion is formed in the gate insulating layer 402, the step of forming the opening portion may be performed either before or after the oxide semiconductor film 430 is subjected to the dehydration or dehydrogenation treatment.

Next, a metal conductive film is formed over the gate insulating layer 402 and the oxide semiconductor layer 431. The metal conductive film may be formed by sputtering or vacuum evaporation. The metal conductive film can be made of an element selected from aluminum (Al), chromium (Cr), copper (Cu), tantalum (Ta), titanium (Ti), molybdenum (Mo), and tungsten (W), an alloy containing any of these elements as a component, an alloy containing a combination of any of these the elements, or the like. Alternatively, one or more materials selected from manganese (Mn), magnesium (Mg), zirconium (Zr), beryllium (Be), and yttrium (Y) may be used. The metal conductive film may have a single-layer structure or a multi-layer structure of two or more layers. For example, the following structures can be given: a single-layer structure of an aluminum film containing silicon; a single-layer structure of a copper film or a film containing copper as a main component; a two-layer structure in which a titanium film is stacked over an aluminum film; a two-layer structure in which a copper film is stacked over a tantalum nitride film or a copper nitride film; and a three-layer structure in which an aluminum film is stacked over a titanium film and another titanium film is stacked over the aluminum film. It is also possible to use a film, an alloy film, or a nitride film which contains aluminum (Al) and one or more of elements selected from titanium (Ti), tantalum (Ta), tungsten (W), molybdenum (Mo), chromium (Cr), neodymium (Nd), and scandium (Sc).

When heat treatment is performed after the formation of the metal conductive film, it is preferable that the metal conductive film have heat resistance enough to withstand the heat treatment.

A resist mask is formed over the metal conductive film by a third photolithography step and etching is selectively performed, whereby a source layer 415*a* and a drain layer 415*b* are formed. Then, the resist mask is removed (see FIG. 17C).

Note that materials and etching conditions are adjusted as appropriate so that the oxide semiconductor layer 431 is not removed in the etching of the metal conductive film.

Here, a titanium film is used as the metal conductive film. Since an In—Ga—Zn—O-based oxide is used for the oxide semiconductor layer 431, an ammonia hydrogen peroxide mixture (a mixed solution of ammonia, water, and a hydrogen peroxide solution) is used as an etchant in consideration of the etching selectivity of the oxide semiconductor layer 431 and the metal conductive film.

Note that in the third photolithography step, part of the oxide semiconductor layer 431 is etched in some cases, whereby a groove (a depressed portion) is formed in the oxide semiconductor layer. The resist mask used in this step may be formed by an inkjet method. In the case of forming the resist mask by an inkjet method, the manufacturing cost can be reduced because a photomask is not used.

In order to reduce the number of photomasks used in a photolithography process and reduce the number of photolithography steps, an etching step may be performed with the use of a multi-tone mask which is a light-exposure mask through which light is transmitted to have a plurality of intensities. Since a resist mask formed using a multi-tone mask has a plurality of thicknesses and can be further changed in shape by ashing, the resist mask can be used in a plurality of etching steps to provide different patterns. Consequently, a resist mask corresponding to at least two or more kinds of different patterns can be formed with one multi-tone mask. Thus, the number of light-exposure masks can be reduced and the number of corresponding photolithography steps can be also reduced, resulting in simplification of the process.

Next, plasma treatment using a gas such as nitrous oxide ($N_2O$), nitrogen ($N_2$), or argon (Ar) is performed. This plasma treatment removes absorbed water and the like attached to an exposed surface of the oxide semiconductor layer. Plasma treatment may be performed using a mixture gas of oxygen and argon.

After the plasma treatment, an oxide insulating layer 416 which serves as a protective insulating film and is in contact with part of the oxide semiconductor layer is formed without exposure to the air.

The oxide insulating layer 416, which has a thickness of at least 1 nm or more, can be formed as appropriate using a method, such as sputtering, with which impurities such as water and hydrogen are not mixed into the oxide insulating layer 416. When hydrogen is contained in the oxide insulating layer 416, the hydrogen enters the oxide semiconductor layer, whereby a back channel of the oxide semiconductor layer 431 comes to have a lower resistance (to be n-type) and thus a parasitic channel might be formed. Therefore, it is important that the oxide insulating layer 416 be formed by a method which does not use hydrogen so that the oxide insulating layer 416 contains as little hydrogen as possible.

Here, a 200-nm-thick silicon oxide film is formed as the oxide insulating layer 416 by sputtering. The substrate temperature in the deposition can be higher than or equal to room temperature and lower than or equal to 300° C.; in this embodiment: 100° C. The silicon oxide film can be formed by sputtering in a rare gas (typically argon) atmosphere, an oxygen atmosphere, or an atmosphere of a rare gas (typically argon) and oxygen. As a target, a silicon oxide target or a silicon target can be used. For example, the silicon oxide film can be formed by sputtering using a silicon target in an atmosphere containing oxygen and nitrogen.

Next, second heat treatment (preferably at 200° C. to 400° C. inclusive, for example, 250° C. to 350° C. inclusive) is performed in an inert gas atmosphere or an oxygen gas atmosphere. For example, the second heat treatment is performed in a nitrogen atmosphere at 250° C. for one hour. Through the second heat treatment, part of the oxide semiconductor layer (a channel formation region) is heated while being in contact with the oxide insulating layer 416. Thus, oxygen is supplied to the part of the oxide semiconductor layer (the channel formation region).

Through the above steps, a region with an extremely high resistance and a region with a relatively low resistance can be formed in the oxide semiconductor layer in a self-aligned manner. That is, when the heat treatment (the first heat treatment) for dehydration or dehydrogenation is performed on the oxide semiconductor layer as described above, oxygen deficiency is caused to increase the conductivity of the oxide semiconductor layer. After that, the source layer 415*a* and the drain layer 415*b* are formed and further the oxide insulating layer 416 is formed; then, the second heat treatment is performed, whereby oxygen is supplied to the part of the oxide semiconductor layer, which is in contact with the oxide insulating layer 416 (a channel formation region 413), so that the oxygen deficiency is removed and an i-type or substantially i-type oxide semiconductor layer is obtained. On the other hand, oxygen is not supplied to the other parts of the oxide semiconductor layer which are in contact with the source layer 415*a* and the drain layer 415*b*; thus, oxygen deficiency is not removed and a relatively low resistance is kept. These parts of the oxide semiconductor layer serve as a source region and a drain region in the transistor. That is, a source region 414*a* overlapping with the source layer 415*a* and a drain region 414*b* overlapping with the drain layer 415*b* are formed in a self-aligned manner. Through the above steps, the transistor 410 is formed.

In a gate-bias thermal stress test (BT test) at 85° C. with $2\times10^6$ V/cm for 12 hours, if an impurity (such as hydrogen) has been in an oxide semiconductor, the bond between the impurity and the main component of the oxide semiconductor is broken by a high electric field (B: bias) and high temperature (T: temperature), so that a generated dangling bond induces a drift in the threshold voltage (Vth). On the other hand, impurities in an oxide semiconductor, especially hydrogen or water, are removed as much as possible, and a dense and high-quality insulating film having high withstand voltage and good interface characteristics with an oxide semiconductor is formed with the high-density plasma CVD apparatus as described above. Then, a transistor which is stable even in the BT test can be obtained.

Furthermore, heat treatment may be performed in the air at 100° C. to 200° C. inclusive for one hour to 30 hours inclusive. Here, the heat treatment is performed at 150° C. for 10 hours. This heat treatment may be performed at a fixed heating temperature; alternatively, the following change in the heating temperature may be repeatedly conducted plural times: the heating temperature is increased from room temperature to a temperature of 100° C. to 200° C. inclusive and then decreased to room temperature. This heat treatment may be performed under a reduced pressure before the oxide insulating film is formed. The heat treatment time can be shortened under the reduced pressure. Through this heat treatment, hydrogen can be taken in the oxide insulating layer from the oxide semiconductor layer.

Note that the reliability of the transistor can be improved by forming the drain region 414*b* in the part of the oxide semiconductor layer which overlaps with the drain layer 415*b*. Specifically, by forming the drain region 414*b*, the conductivity can be changed gradually from the drain layer 415*b*, the drain region 414*b*, and to the channel formation region 413.

The source region or the drain region in the oxide semiconductor layer is formed in the entire thickness direction in the case where the thickness of the oxide semiconductor layer is as small as 15 nm or less. In the case where the thickness of the oxide semiconductor layer is 30 nm to 50 nm inclusive, resistance is reduced in part of the oxide semiconductor layer, namely, in a region in the oxide semiconductor layer which is in contact with the source layer or the drain layer, and the vicinity thereof, and the source region or the drain region is formed, while another region in the oxide semiconductor layer which is close to the gate insulating layer can be made to be i-type.

A protective insulating layer may be further formed over the oxide insulating layer 416. For example, a silicon nitride film is formed by RF sputtering. The RF sputtering is preferably used for forming the protective insulating layer because high productivity is achieved. The protective insulating layer is formed using an inorganic insulating film which does not include impurities such as moisture, a hydrogen ion, and $OH^-$ and blocks entry of these impurities from the outside; for example, a silicon nitride film, an aluminum nitride film, a silicon nitride oxide film, or an aluminum oxynitride film is used. Here, as the protective insulating layer, a protective insulating layer 403 is formed using a silicon nitride film (see FIG. 17D).

(Variety of Electronic Apparatuses Including Display Device)

Examples of the electronic apparatus including the display device disclosed in this specification will be described below with reference to FIGS. 18A to 18F.

Figure 18A:
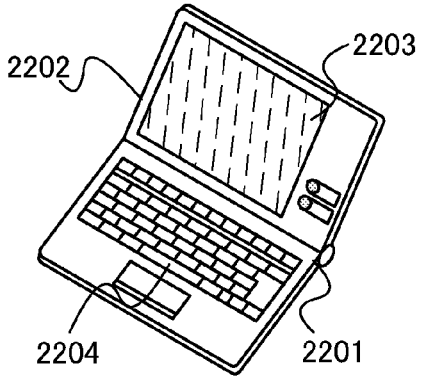
FIGS. 18A to 18F are views each illustrating an example of an electronic apparatus.

FIG. 18A illustrates a laptop computer, which includes a main body 2201, a housing 2202, a display portion 2203, a keyboard 2204, and the like.

Figure 18B:
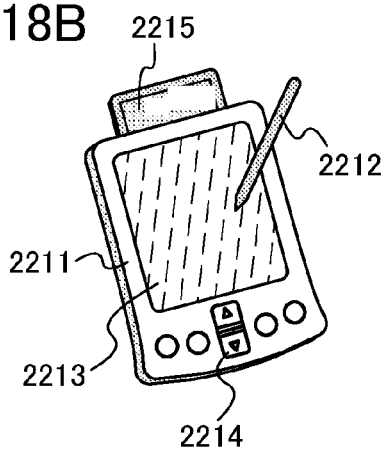

FIG. 18B illustrates a personal digital assistant (PDA), which includes a main body 2211 provided with a display portion 2213, an external interface 2215, an operation button 2214, and the like. A stylus 2212 is provided as an accessory for operation.

Figure 18C:
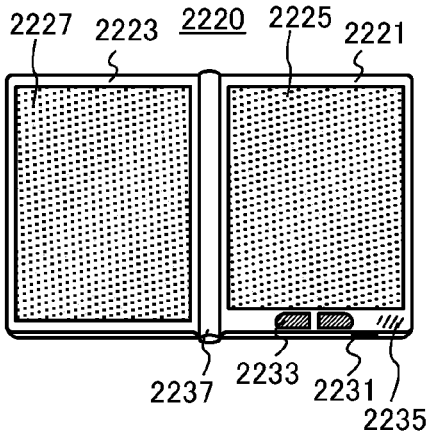

FIG. 18C illustrates an e-book reader 2220 as an example of electronic paper. The e-book reader 2220 includes two housings, a housing 2221 and a housing 2223. The housings 2221 and 2223 are bound with each other by an axis portion 2237, along which the e-book reader 2220 can be opened and closed. With such a structure, the e-book reader 2220 can be used as paper books.

A display portion 2225 is incorporated in the housing 2221, and a display portion 2227 is incorporated in the housing 2223. The display portion 2225 and the display portion 2227 may display one image or different images. When the e-book reader 2220 has a structure in which different images are displayed on the display portions, for example, text can be displayed on the right display portion (the display portion 2225 in FIG. 18C) and images can be displayed on the left display portion (the display portion 2227 in FIG. 18C).

Further, in FIG. 18C, the housing 2221 is provided with an operation portion and the like. For example, the housing 2221 includes a power button 2231, an operation key 2233, and a speaker 2235. With the operation key 2233, pages can be turned. Note that a keyboard, a pointing device, or the like may also be provided on the surface of the housing, on which the display portion is provided. Furthermore, an external connection terminal (an earphone terminal, a USB terminal, a terminal that can be connected to various cables such as an AC adapter and a USB cable, or the like), a recording medium insertion portion, and the like may be provided on the back surface or the side surface of the housing. The e-book reader 2220 may also have a function of an electronic dictionary.

The e-book reader 2220 may be configured to transmit and receive data wirelessly. Through wireless communication, desired book data or the like can be purchased and downloaded from an e-book server.

Note that the electronic paper can be applied to devices in a variety of fields as long as they display information. For example, the electronic paper can be used for posters, advertisement in vehicles such as trains, and display in a variety of cards such as credit cards in addition to e-book readers.

Figure 18D:
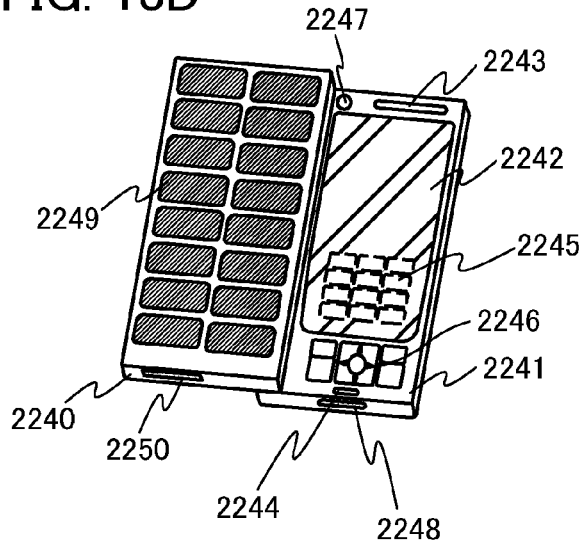

FIG. 18D illustrates a mobile phone, which includes two housings: a housing 2240 and a housing 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 which charges the mobile phone, an external memory slot 2250, and the like. An antenna is incorporated in the housing 2241.

The display panel 2242 has a touch panel function. A plurality of operation keys 2245 which is displayed as images is illustrated by dashed lines in FIG. 18D. Note that the mobile phone includes a booster circuit for increasing a voltage output from the solar cell 2249 to a voltage needed for each circuit. The mobile phone can also include a contactless IC chip, a small recording device, or the like in addition to the above structure.

The display orientation of the display panel 2242 changes as appropriate in accordance with the application mode. Further, the camera lens 2247 is provided on the same surface as the display panel 2242, and thus the mobile phone can be used as a video phone. The speaker 2243 and the microphone 2224 can be used for videophone calls, recording, and playing sound, etc. as well as voice calls. Moreover, the housings 2240 and 2241 which are developed as illustrated in FIG. 18D can be slid so that one is lapped over the other, resulting in a reduction in the size of the mobile phone so as to be suitable for being carried.

The external connection terminal 2248 can be connected to an AC adapter or a variety of cables such as a USB cable, which enables charging of the mobile phone and data communication. When a recording medium is inserted to the external memory slot 2250, a larger amount of data can be stored and moved. In addition to the above functions, an infrared communication function, a television reception function, or the like may be provided.

Figure 18E:
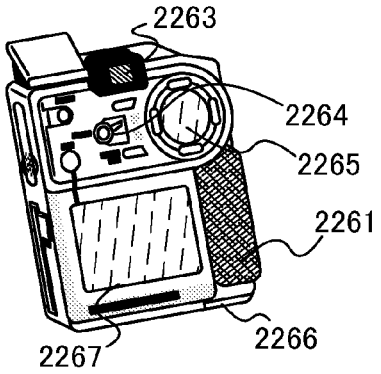

FIG. 18E illustrates a digital camera, which includes a main body 2261, a display portion (A) 2267, an eyepiece 2263, an operation switch 2264, a display portion (B) 2265, a battery 2266, and the like.

Figure 18F:
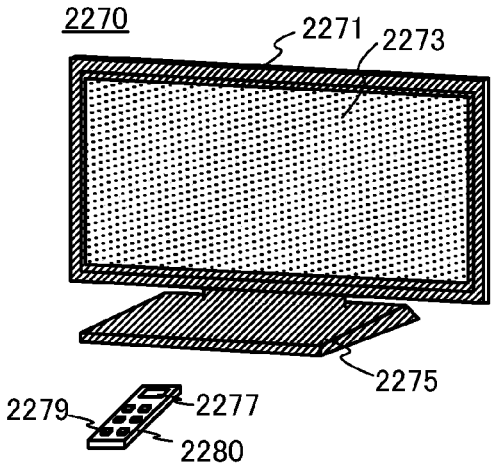

FIG. 18F illustrates a television set 2270 in which a display portion 2273 is incorporated in a housing 2271. Images can be displayed on the display portion 2273. Here, the housing 2271 is supported by a stand 2275.

The television set 2270 can be operated with an operation switch of the housing 2271 or a separate remote controller 2280. Channels and volume can be controlled with an operation key 2279 of the remote controller 2280 so that an image displayed on the display portion 2273 can be controlled. The remote controller 2280 may have a display portion 2227 on which the information output from the remote controller 2280 is displayed.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

This application is based on Japanese Patent Application serial no. 2010-050869 filed with Japan Patent Office on Mar. 8, 2010, the entire contents of which are hereby incorporated by reference.

The invention claimed is:

1. A display device comprising:

a controller configured to output a row rewriting control signal indicating whether there is a difference between successive two frames in at least one of a first pixel to an n-th pixel (n is a natural number of two or more) arranged in the same row, and a column rewriting control signal indicating whether there is a difference between the successive two frames in a k-th pixel (k is a natural number more than or equal to one and less than or equal to n);

a first scan line electrically connected to the first pixel to the n-th pixel, the first scan line being operationally connected to the controller;

a second scan line electrically connected to pixels arranged in the same column as the k-th pixel, the second scan line being operationally connected to the controller;

a signal line electrically connected to the pixels arranged in the same column as the k-th pixel, the signal line being operationally connected to the controller, a first shift register for driving the first scan line, which is configured to sequentially output selection signals from output terminals in a first sampling period for driving the first scan line;

a first latch for driving the first scan line, which is configured to retain the row rewriting control signal supplied when a selection signal is input, and output the row rewriting control signal in a vertical retrace period following the first sampling period for driving the first scan line;

a second latch for driving the first scan line, which is configured to retain the row rewriting control signal input from the first latch for driving the first scan line, and output the row rewriting control signal in the vertical retrace period and a second sampling period for driving the first scan line following the vertical retrace period; and a first buffer configured to select, in accordance with the row rewriting control signal input from the second latch for driving the first scan line, whether a selection signal is supplied to the first scan line in a horizontal scan period included in the second sampling period for driving the first scan line, wherein the k-th pixel comprises:

a first transistor, a gate of which is electrically connected to the first scan line and one of a source and a drain of which is electrically connected to the signal line without passing through a semiconductor; and a second transistor, a gate of which is electrically connected to the second scan line and one of a source and a drain of which is electrically connected to the other of the source and the drain of the first transistor without passing through the semiconductor.

2. The display device according to claim 1, further comprising:

a second shift register for driving the signal line and the second scan line, which is configured to sequentially output selection signals from output terminals in a first sampling period for driving the signal line and the second scan line;

a third latch for driving the signal line and the second scan line, which is configured to retain the column rewriting control signal supplied when a selection signal is input, and output the column rewriting control signal in a horizontal retrace period following the first sampling period for driving the signal line and the second scan line;

a fourth latch for driving the signal line and the second scan line, which is configured to retain the column rewriting control signal output from the third latch for driving the signal line and the second scan line, and output the column rewriting control signal to the second scan line in a horizontal scan period including the horizontal retrace period and a second sampling period for driving the signal line and the second scan line following the horizontal retrace period;

a fifth latch for driving the signal line and the second scan line, which is configured to retain a data signal supplied when a selection signal is input, and output the data signal in the horizontal retrace period;

a sixth latch for driving the signal line and the second scan line, which is configured to retain the data signal output from the fifth latch for driving the signal line and the second scan line, and outputs the data signal in the horizontal scan period;

a digital to analog converter circuit which is configured to convert the data signal output from the sixth latch for driving the signal line and the second scan line into an analog data signal; and an analog buffer which is configured to select, in accordance with the column rewriting control signal, whether the analog data signal is supplied to the signal line in the horizontal scan period.

3. The display device according to claim 1, further comprising:

a second shift register for driving the signal line and the second scan line, which is configured to sequentially output selection signals from output terminals;

an AND gate whose first input terminal is electrically connected to any of the output terminals of the second shift register for driving the signal line and the second scan line, whose second input terminal is electrically connected to a wiring supplying the column rewriting control signal, and whose output terminal is electrically connected to the second scan line;

a third latch for driving the signal line and the second scan line, which is configured to retain a data signal supplied when a selection signal is input, and output the data signal;

a digital to analog converter circuit which is configured to convert the data signal output from the third latch for driving the signal line and the second scan line into an analog data signal; and an analog buffer which is configured to select, in accordance with an output signal of the AND gate, whether the analog data signal input from the digital to analog converter circuit is supplied to the signal line.

4. The display device according to claim 1, wherein the controller comprises:

a frame memory which is configured to store data signals for forming images of a plurality of frames;

a comparator circuit which is configured to compare the data signals stored in the frame memory and forming images of successive two frames, and detect a difference;

a coordinate memory which is configured to store a coordinate data of a pixel in which the difference has been detected by the comparator circuit;

a data signal reading circuit which is configured to read a data signal from the frame memory and outputs the data signal to a signal line and second scan line driver circuit; and a rewriting signal generation circuit which is configured to generate the column rewriting control signal and the row rewriting control signal on the basis of the coordinate data stored in the coordinate memory, and output the column rewriting control signal and the row rewriting control signal to the signal line and second scan line driver circuit and a first scan line driver circuit, respectively.

5. The display device according to claim 1, wherein a channel formation region of the first transistor is included in a first oxide semiconductor layer and a channel formation region of the second transistor is included in a second oxide semiconductor layer.

6. A display device comprising:

a controller configured to detect a difference in each of a plurality of pixels arranged in matrix by comparing data signals for forming images of successive two frames, and output a row rewriting control signal indicating whether the difference is detected in at least one of a first pixel to an n-th pixel (n is a natural number of two or more) arranged in the same row, and a column rewriting control signal indicating whether the difference is detected in a k-th pixel (k is a natural number more than or equal to one and less than or equal to n);

a first scan line which is electrically connected to the first pixel to the n-th pixel and to which a selection signal is supplied in accordance with the row rewriting control signal;

a second scan line which is electrically connected to pixels arranged in the same column as the k-th pixel and to which a selection signal is supplied in accordance with the column rewriting control signal;

a signal line which is electrically connected to the pixels arranged in the same column as the k-th pixel and to which the data signals are supplied in accordance with the column rewriting control signal, a first shift register for driving the first scan line, which is configured to sequentially output selection signals from output terminals in a first sampling period for driving the first scan line;

a first latch for driving the first scan line, which is configured to retain the row rewriting control signal supplied when a selection signal is input, and output the row rewriting control signal in a vertical retrace period following the first sampling period for driving the first scan line;

a second latch for driving the first scan line, which is configured to retain the row rewriting control signal input from the first latch for driving the first scan line, and output the row rewriting control signal in the vertical retrace period and a second sampling period for driving the first scan line following the vertical retrace period; and a buffer configured to select, in accordance with the row rewriting control signal input from the second latch for driving the first scan line, whether a selection signal is supplied to the first scan line in a horizontal scan period included in the second sampling period for driving the first scan line, wherein the k-th pixel comprises:

a first transistor, a gate of which is electrically connected to the first scan line and one of a source and a drain of which is electrically connected to the signal line without passing through a semiconductor; and a second transistor, a gate of which is electrically connected to the second scan line and one of a source and a drain of which is electrically connected to the other of the source and the drain of the first transistor without passing through the semiconductor.

7. The display device according to claim 6, further comprising:

a second shift register for driving the signal line and the second scan line, which is configured to sequentially output selection signals from output terminals in a first sampling period for driving the signal line and the second scan line;

a third latch for driving the signal line and the second scan line, which is configured to retain the column rewriting control signal supplied when a selection signal is input, and output the column rewriting control signal in a horizontal retrace period following the first sampling period for driving the signal line and the second scan line;

a fourth latch for driving the signal line and the second scan line, which is configured to retain the column rewriting control signal output from the third latch for driving the signal line and the second scan line, and output the column rewriting control signal to the second scan line in a horizontal scan period including the horizontal retrace period and a second sampling period for driving the signal line and the second scan line following the horizontal retrace period;

a fifth latch for driving the signal line and the second scan line, which is configured to retain a data signal supplied when a selection signal is input, and output the data signal in the horizontal retrace period;

a sixth latch for driving the signal line and the second scan line, which is configured to retain the data signal output from the fifth latch for driving the signal line and the second scan line, and outputs the data signal in the horizontal scan period;

a digital to analog converter circuit which is configured to convert the data signal output from the sixth latch for driving the signal line and the second scan line into an analog data signal; and an analog buffer which is configured to select, in accordance with the column rewriting control signal, whether the analog data signal is supplied to the signal line in the horizontal scan period.

8. The display device according to claim 6, further comprising:

a second shift register for driving the signal line and the second scan line, which is configured to sequentially output selection signals from output terminals;

an AND gate whose first input terminal is electrically connected to any of the output terminals of the second shift register for driving the signal line and the second scan line, whose second input terminal is electrically connected to a wiring supplying the column rewriting control signal, and whose output terminal is electrically connected to the second scan line;

a third latch for driving the signal line and the second scan line, which is configured to retain a data signal supplied when a selection signal is input, and output the data signal;

a digital to analog converter circuit which is configured to convert the data signal output from the third latch for driving the signal line and the second scan line into an analog data signal; and an analog buffer which is configured to select, in accordance with an output signal of the AND gate, whether the analog data signal input from the digital to analog converter circuit is supplied to the signal line.

9. The display device according to claim 6, wherein the controller comprises:

a frame memory which is configured to store data signals for forming images of a plurality of frames;

a comparator circuit which is configured to compare the data signals stored in the frame memory and forming images of successive two frames, and detect a difference;

a coordinate memory which is configured to store a coordinate data of a pixel in which the difference has been detected by the comparator circuit;

a data signal reading circuit which is configured to read a data signal from the frame memory and outputs the data signal to a signal line and second scan line driver circuit; and a rewriting signal generation circuit which is configured to generate the column rewriting control signal and the row rewriting control signal on the basis of the coordinate data stored in the coordinate memory, and output the column rewriting control signal and the row rewriting control signal to the signal line and second scan line driver circuit and a first scan line driver circuit, respectively.

10. The display device according to claim 6, wherein a channel formation region of the first transistor is included in a first oxide semiconductor layer and a channel formation region of the second transistor is included in a second oxide semiconductor layer.

11. A display device comprising:

a controller configured to detect a difference in each of a plurality of pixels arranged in matrix by comparing data signals for forming images of successive two frames, and output a row rewriting control signal indicating whether the difference is detected in at least one of a first pixel to an n-th pixel (n is a natural number of two or more) arranged in the same row, and a column rewriting control signal indicating whether the difference is detected in a k-th pixel (k is a natural number more than or equal to one and less than or equal to n);

a first scan line which is electrically connected to the first pixel to the n-th pixel and to which a selection signal is supplied in accordance with the row rewriting control signal;

a second scan line which is electrically connected to pixels arranged in the same column as the k-th pixel and to which a selection signal is supplied in accordance with the column rewriting control signal; and a signal line which is electrically connected to the pixels arranged in the same column as the k-th pixel and to which the data signals are supplied in accordance with the column rewriting control signal, a first shift register for driving the first scan line, which is configured to sequentially output selection signals from output terminals in a first sampling period for driving the first scan line;

a first latch for driving the first scan line, which is configured to retain the row rewriting control signal supplied when a selection signal is input, and output the row rewriting control signal in a vertical retrace period following the first sampling period for driving the first scan line;

a second latch for driving the first scan line, which is configured to retain the row rewriting control signal input from the first latch for driving the first scan line, and output the row rewriting control signal in the vertical retrace period and a second sampling period for driving the first scan line following the vertical retrace period; and a buffer configured to select, in accordance with the row rewriting control signal input from the second latch for driving the first scan line, whether a selection signal is supplied to the first scan line in a horizontal scan period included in the second sampling period for driving the first scan line, wherein the k-th pixel comprises:

a first transistor, a gate of which is electrically connected to the first scan line and one of a source and a drain of which is electrically connected to the signal line without passing through a semiconductor;

a second transistor, a gate of which is electrically connected to the second scan line and one of a source and a drain of which is electrically connected to the other of the source and the drain of the first transistor without passing through the semiconductor; and a display element which is electrically connected to the other of the source and the drain of the second transistor.

12. The display device according to claim 11, further comprising:

a second shift register for driving the signal line and the second scan line, which is configured to sequentially output selection signals from output terminals in a first sampling period for driving the signal line and the second scan line;

a third latch for driving the signal line and the second scan line, which is configured to retain the column rewriting control signal supplied when a selection signal is input, and output the column rewriting control signal in a horizontal retrace period following the first sampling period for driving the signal line and the second scan line;

a fourth latch for driving the signal line and the second scan line, which is configured to retain the column rewriting control signal output from the third latch for driving the signal line and the second scan line, and output the column rewriting control signal to the second scan line in a horizontal scan period including the horizontal retrace period and a second sampling period for driving the signal line and the second scan line following the horizontal retrace period;

a fifth latch for driving the signal line and the second scan line, which is configured to retain a data signal supplied when a selection signal is input, and output the data signal in the horizontal retrace period;

a sixth latch for driving the signal line and the second scan line, which is configured to retain the data signal output from the fifth latch for driving the signal line and the second scan line, and outputs the data signal in the horizontal scan period;

a digital to analog converter circuit which is configured to convert the data signal output from the sixth latch for driving the signal line and the second scan line into an analog data signal; and an analog buffer which is configured to select, in accordance with the column rewriting control signal, whether the analog data signal is supplied to the signal line in the horizontal scan period.

13. The display device according to claim 11, further comprising:

a second shift register for driving the signal line and the second scan line, which is configured to sequentially output selection signals from output terminals;

an AND gate whose first input terminal is electrically connected to any of the output terminals of the second shift register for driving the signal line and the second scan line, whose second input terminal is electrically connected to a wiring supplying the column rewriting control signal, and whose output terminal is electrically connected to the second scan line;

a third latch for driving the signal line and the second scan line, which is configured to retain a data signal supplied when a selection signal is input, and output the data signal;

a digital to analog converter circuit which is configured to convert the data signal output from the third latch for driving the signal line and the second scan line into an analog data signal; and an analog buffer which is configured to select, in accordance with an output signal of the AND gate, whether the analog data signal input from the digital to analog converter circuit is supplied to the signal line.

14. The display device according to claim 11, wherein the controller comprises:

a frame memory which is configured to store data signals for forming images of a plurality of frames;

a comparator circuit which is configured to compare the data signals stored in the frame memory and forming images of successive two frames, and detect a difference;

a coordinate memory which is configured to store a coordinate data of a pixel in which the difference has been detected by the comparator circuit;

a data signal reading circuit which is configured to read a data signal from the frame memory and outputs the data signal to a signal line and second scan line driver circuit; and a rewriting signal generation circuit which is configured to generate the column rewriting control signal and the row rewriting control signal on the basis of the coordinate data stored in the coordinate memory, and output the column rewriting control signal and the row rewriting control signal to the signal line and second scan line driver circuit and a first scan line driver circuit, respectively.

15. The display device according to claim 11, wherein a channel formation region of the first transistor is included in a first oxide semiconductor layer and a channel formation region of the second transistor is included in a second oxide semiconductor layer.

* * * * *